US008872865B2

(12) United States Patent
Wu et al.

(10) Patent No.: US 8,872,865 B2
(45) Date of Patent: Oct. 28, 2014

(54) PIXEL-DRIVING CIRCUIT

(75) Inventors: Meng-Ju Wu, Hsin-Chu (TW); Chun-Fan Chung, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 186 days.

(21) Appl. No.: 13/281,445

(22) Filed: Oct. 26, 2011

(65) Prior Publication Data

US 2012/0105500 A1 May 3, 2012

(30) Foreign Application Priority Data

Nov. 2, 2010 (TW) ..... 99137694 A

(51) Int. Cl.
*G09G 5/10* (2006.01)
*G09G 3/36* (2006.01)

(52) U.S. Cl.
CPC ..... *G09G 3/3688* (2013.01); *G09G 2310/0297* (2013.01); *G09G 2300/0447* (2013.01); *G09G 2310/027* (2013.01); *G09G 3/3614* (2013.01)
USPC ..... 345/690; 345/89; 345/100

(58) Field of Classification Search
CPC ..... G09G 3/3688; G09G 3/3614; G09G 2310/0297; G09G 2310/027; G09G 2300/0447
USPC ..... 345/211, 87, 690, 89, 98, 100
See application file for complete search history.

(56) References Cited

U.S. PATENT DOCUMENTS

| | | | | |
|---|---|---|---|---|
| 5,521,946 | A | 5/1996 | Main | |
| 7,382,344 | B2 * | 6/2008 | Lee et al. | 345/99 |
| 2008/0122672 | A1 * | 5/2008 | Chang et al. | 341/145 |
| 2011/0261041 | A1 * | 10/2011 | Cheng | 345/208 |

* cited by examiner

*Primary Examiner* — Chanh Nguyen
*Assistant Examiner* — Tsegaye Seyoum
(74) *Attorney, Agent, or Firm* — Winston Hsu; Scott Margo

(57) ABSTRACT

A pixel driving circuit includes a first pixel, a second pixel, and a data driving circuit. Each pixel includes a main region and a sub region. The main region stores a gray level voltage and the sub region stores a gray level voltage corresponding to the gray level voltage stored in the main region when the main region and the sub region display image. In the data driving circuit, first, second, third, and fourth gray level voltages are generated by means of a first selecting circuit outputting first digital data corresponding to the first pixel and second digital data corresponding to the second pixel to the corresponding digital-to-analog converters. The first, second, third, and fourth gray level voltages are distributed to the main and sub regions of the first and second pixels by a second selecting circuit, thereby reducing the number of digital-to-analog converters.

20 Claims, 10 Drawing Sheets

PIXEL-DRIVING CIRCUIT

BACKGROUND OF THE INVENTION

1. Field of the Invention

The present invention is related to a pixel driving circuit, and more particularly, to a pixel driving circuit in which a number of digital-to-analog converters required by a data driving circuit can be reduced.

2. Description of the Prior Art

Please refer to FIG. 1. FIG. 1 is a diagram illustrating a pixel driving circuit 100 of the prior art for reducing color washout. The pixel driving circuit 100 comprises a plurality of pixels, data lines $DL_1$-$DL_M$, scan lines $SL_1$-$SL_N$, a data driving circuit 110 and a scan driving circuit 120. Pixels $PIX_1$ and $PIX_2$ are utilized to exemplify structures of the plurality of pixels. The pixel $PIX_1$ comprises transistors $Q_1$ and $Q_2$, a main region $MR_1$ and a sub region $SR_1$. The transistor $Q_1$ comprises a first electrode 1, a second electrode 2 and a gate end G. The first electrode 1 of the transistor $Q_1$ is coupled to the data line $DL_X$, the second electrode 2 of the transistor $Q_1$ is coupled to the main region $MR_1$, and the gate end G of the transistor $Q_1$ is coupled to a scan line $SL_Y$. The transistor $Q_2$ comprises a first electrode 1, a second electrode 2 and a gate end G. The first electrode 1 of the transistor $Q_2$ is coupled to the data line $DL_{(X+1)}$, the second electrode 2 of the transistor $Q_2$ is coupled to the sub region $SR_1$, and the gate end G of the transistor $Q_2$ is coupled to the scan line $SL_Y$. The pixel $PIX_2$ comprises transistors $Q_3$ and $Q_4$, a main region $MR_2$ and a sub region $SR_2$. The transistor $Q_3$ comprises a first electrode 1, a second electrode 2 and a gate end G. The first electrode 1 of the transistor $Q_3$ is coupled to the data line $DL_{(X+2)}$, the second electrode 2 of the transistor $Q_3$ is coupled to the sub region $SR_2$, and the gate end G of the transistor $Q_3$ is coupled to the scan line $SL_Y$. The transistor $Q_4$ comprises a first electrode 1, a second electrode 2 and a gate end G. The first electrode 1 of the transistor $Q_4$ is coupled to the data line $DL_{(X+3)}$, the second electrode 2 of the transistor $Q_4$ is coupled to the main region $MR_2$, and the gate end G of the transistor $Q_2$ is coupled to the scan line $SL_Y$.

When a scan driving circuit 120 drives the scan line $SL_Y$, transistors $Q_1$-$Q_4$ are turned on, for the main region $MR_1$ to couple to the data line $DL_X$ via the transistor $Q_1$, the sub region $SR_1$ to couple to the data line $DL_{(X+1)}$ via the transistor $Q_2$, the sub region $SR_2$ to couple to the data line $DL_{(X+2)}$ via the transistor $Q_3$, and the main region $MR_2$ to couple to the data line $DL_{(X+3)}$ via the transistor $Q_4$.

Assume the pixel $PIX_1$ is to display frames corresponding to digital data $DA_1$, and the pixel $PIX_2$ is to display frames corresponding to digital data $DA_2$. For the pixel $PIX_1$, the main region $MR_1$ and the sub region $SR_1$ receive and store gray level voltages corresponding to the digital data $DA_1$ from the data driving circuit 110 via data lines $D_X$ and $D_{(X+1)}$ respectively. For the pixel $PIX_2$, the main region $MR_2$ and the sub region $SR_2$ receive and store gray level voltages corresponding to the digital data $DA_2$ from the data driving circuit 110 via data lines $D_{(X+3)}$ and $D_{(X+2)}$ respectively. Further, a voltage level of the gray level voltage stored in the main region $MR_1$ corresponds to a voltage level of the gray level voltage stored in the sub region $SR_1$, and a voltage level of the gray level voltage stored in the main region $MR_2$ also corresponds to a voltage level of the gray level voltage stored in the sub region $SR_2$, so as to reduce color offset when viewing the pixel driving circuit 100 from different viewing angles.

However, since in the pixel driving circuit 100, the gray level voltage stored in the main region $MR_1$ is different from that of the sub region $SR_1$, the gray level voltage stored in the main region $MR_2$ is different from that of the sub region $SR_2$, and a rotating polarity for each region ($MR_1$, $MR_2$, $SR_1$, $SR_2$) can be positive or negative, the data driving circuit 110 requires a corresponding digital-to-analog converter and a corresponding negative digital-to-analog converter for each of the data lines $DL_X$-$DL_{(X+3)}$, for providing positive and negative gray level voltages to the main regions $MR_1$ and $MR_2$ and sub regions $SR_1$ and $SR_2$. In other words, when the pixel driving circuit 100 comprises M data lines, the data driving circuit 110 requires 2*M digital-to-analog converters. Since digital-to-analog converters occupy substantial circuit area, the cost of the data driving circuit 110 and the power consumption of the pixel driving circuit 100 are significantly increased, causing inconvenience to the user.

SUMMARY OF THE INVENTION

The present invention discloses a pixel driving circuit. The pixel driving circuit comprises a first pixel, a second pixel and a data driving circuit. The first pixel comprises a first main region and a first sub region. The first main region is coupled to a first data line and a scan line. The first sub region is coupled to a second data line and the scan line. Each of the first main region and the first sub region stores a gray level voltage corresponding to first digital data. The second pixel comprises a second main region and a second sub region. The second sub region is coupled to a third data line and the scan line. The second main region is coupled to a fourth data line and the scan line. Each of the second main region and the second sub region stores a gray level voltage corresponding to second digital data. The data driving circuit comprises a first digital-to-analog converter, a second digital-to-analog converter, a third digital-to-analog converter, a fourth digital-to-analog converter, a first selecting circuit and a second selecting circuit. The first digital-to-analog converter is for converting the first digital data or the second digital data to a first gray level voltage according to a positive main region gamma voltage. The second digital-to-analog converter is for converting the first digital data or the second digital data to a second gray level voltage according to a positive sub region gamma voltage. The third digital-to-analog converter is for converting the first digital data or the second digital data to a third gray level voltage according to a negative sub region gamma voltage. The fourth digital-to-analog converter is for converting the first digital data or the second digital data to a fourth gray level voltage according to a negative main region gamma voltage. The first selecting circuit is for selecting the first digital data according to a gamma voltage selecting signal and a polarity signal, for inputting the first digital data into two digital-to-analog converters of the first, the second, the third and the fourth digital-to-analog converters, and inputting the second digital data into the other two digital-to-analog converters of the first, the second, the third and the fourth digital-to-analog converters. The second selecting circuit is for distributing the first, the second, the third and the fourth gray level voltages to the first main region, the second main region, the first sub region and the second sub region via the first, the second, the third and the fourth data lines, according to the gamma voltage selecting signal and the polarity signal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
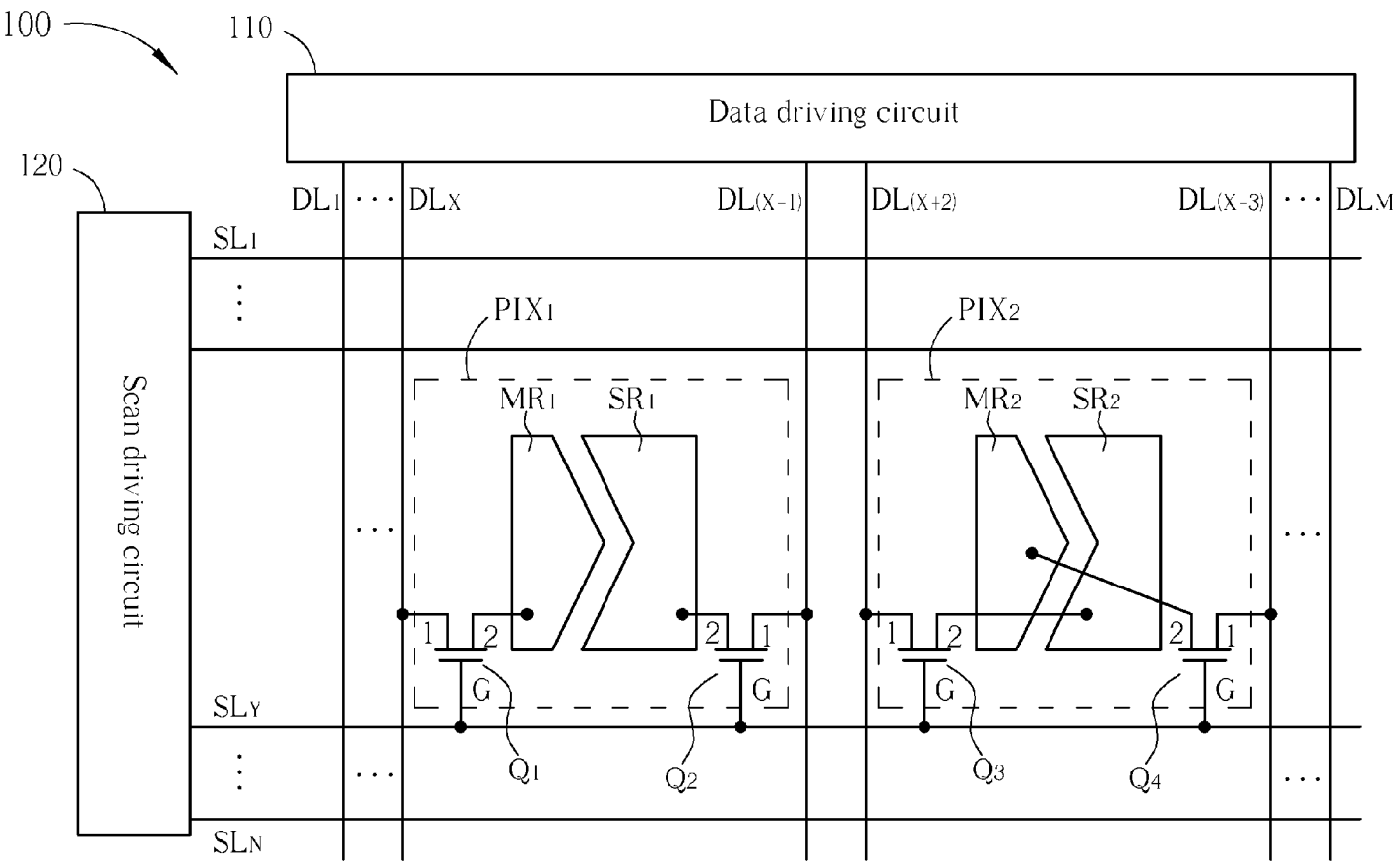
FIG. 1 PRIOR ART
FIG. 1 is a diagram illustrating a pixel driving circuit of prior art for reducing color washout.
Figure 2:
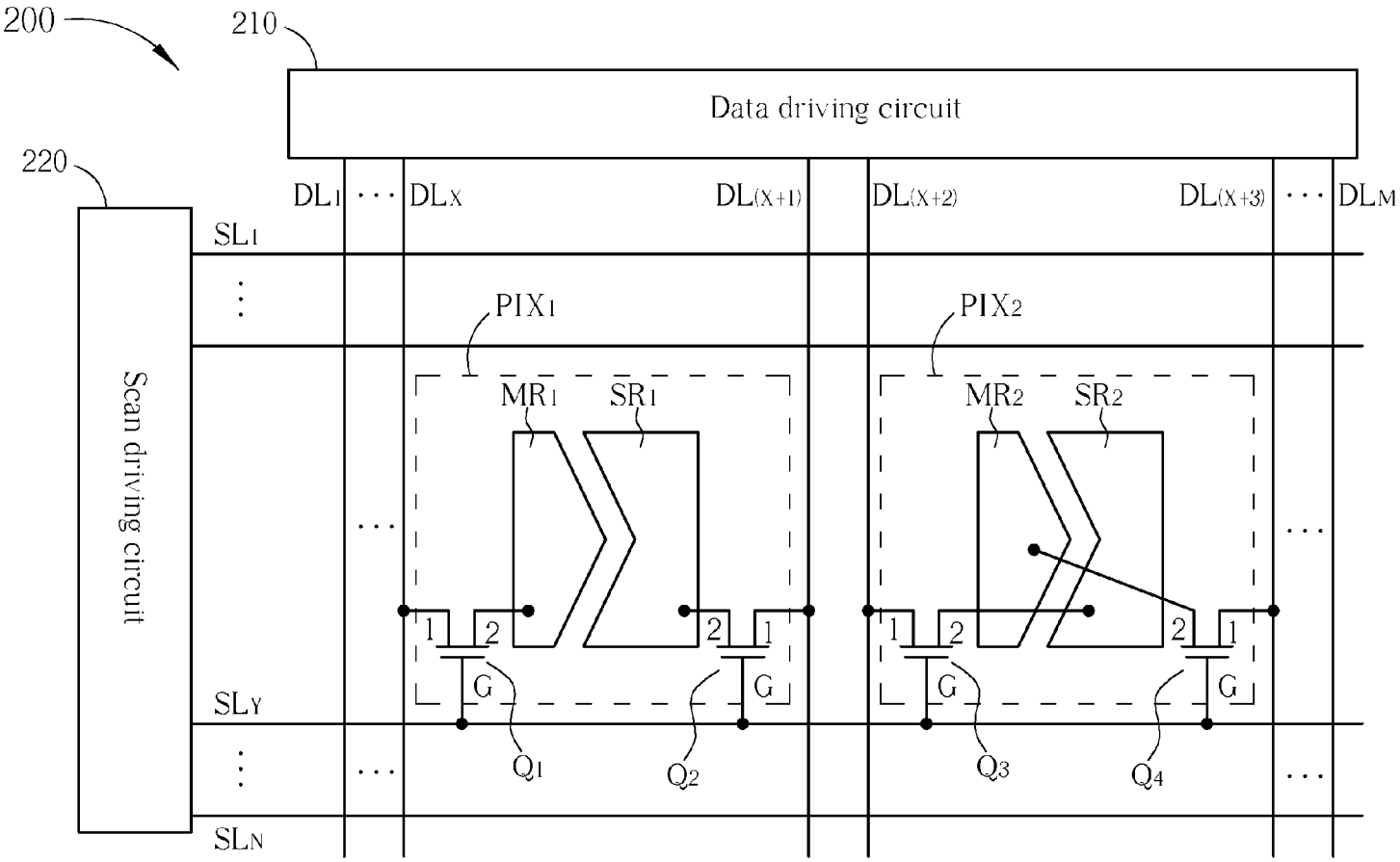
FIG. 2 is a diagram illustrating a pixel driving circuit according to an embodiment of the present invention.
Figure 3:
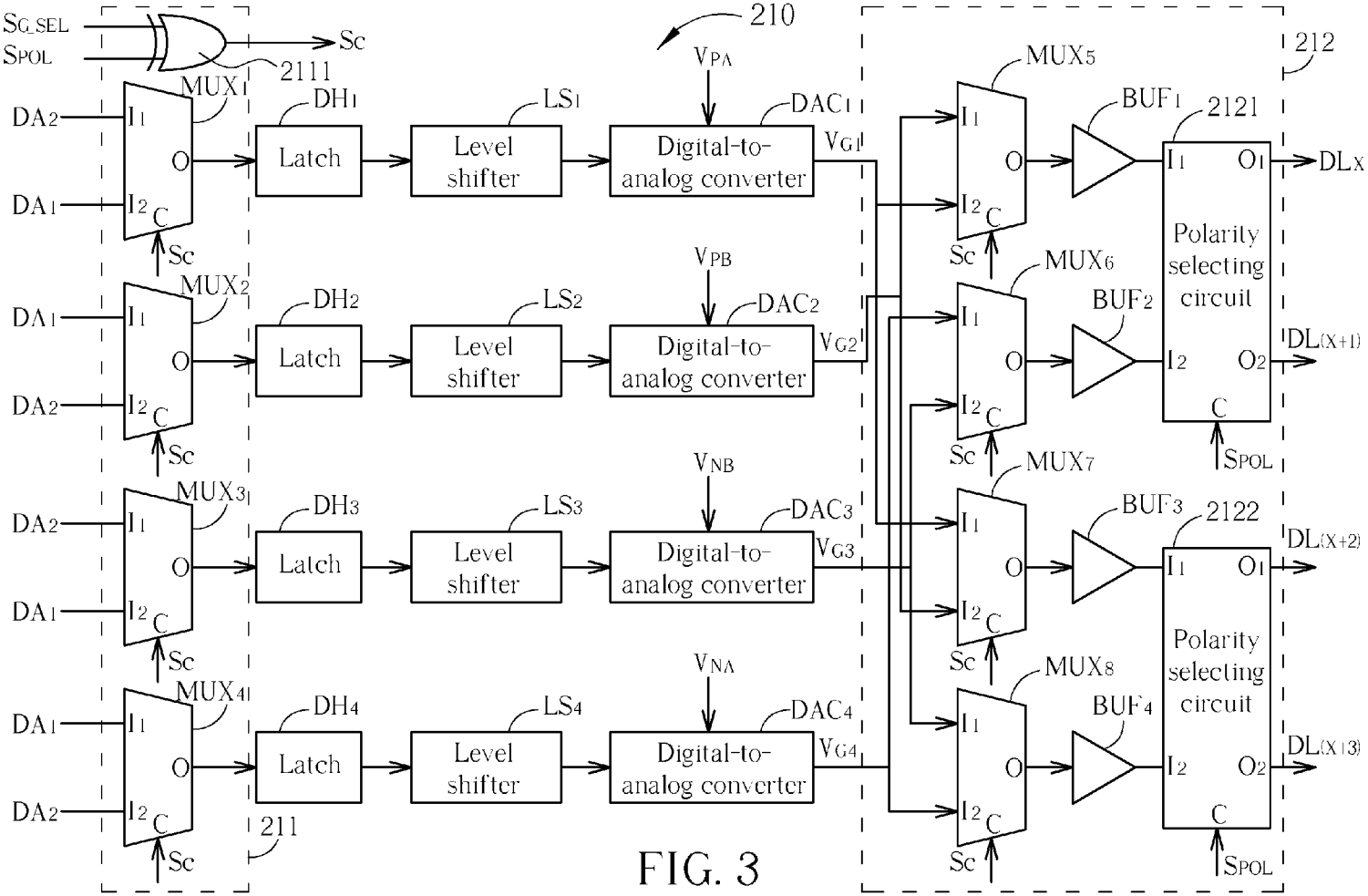
FIG. 3 is a diagram illustrating a partial structure of a data driving circuit in FIG. 2.

Please refer to FIG. 2 and FIG. 3. FIG. 2 is a diagram illustrating a pixel driving circuit 200 according to an embodiment of the present invention. FIG. 3 is a diagram illustrating a partial structure of a data driving circuit 210 in FIG. 2. The pixel driving circuit 200 comprises a plurality of pixels, data lines $DL_1$-$DL_m$, scan lines $SL_1$-$SL_N$, a data driving circuit 210 and a scan driving circuit 220. Pixels $PIX_1$ and $PIX_2$ are utilized to exemplify structures of the plurality of pixels. The pixel $PIX_1$ comprises transistors $Q_1$ and $Q_2$, a main region $MR_1$ and a sub region $SR_1$. The transistor $Q_1$ comprises a first electrode 1, a second electrode 2 and a gate end G. The first electrode 1 of the transistor $Q_1$ is coupled to the data line $DL_X$, the second electrode 2 of the transistor $Q_1$ is coupled to the main region $MR_1$, and the gate end G of the transistor $Q_1$ is coupled to a scan line $SL_Y$. The transistor $Q_2$ comprises a first electrode 1, a second electrode 2 and a gate end G. The first electrode 1 of the transistor $Q_2$ is coupled to the data line $DL_{(X+1)}$, the second electrode 2 of the transistor $Q_2$ is coupled to the sub region $SR_1$, and the gate end G of the transistor $Q_2$ is coupled to the scan line $SL_Y$. The pixel $PIX_2$ comprises transistors $Q_3$ and $Q_4$, a main region $MR_2$ and a sub region $SR_2$. The transistor $Q_3$ comprises a first electrode 1, a second electrode 2 and a gate end G. The first electrode 1 of the transistor $Q_3$ is coupled to the data line $DL_{(X+2)}$, the second electrode 2 of the transistor $Q_3$ is coupled to the sub region $SR_2$, and the gate end G of the transistor $Q_3$ is coupled to the scan line $SL_Y$. The transistor $Q_4$ comprises a first electrode 1, a second electrode 2 and a gate end G. The first electrode 1 of the transistor $Q_4$ is coupled to the data line $DL_{(X+3)}$, the second electrode 2 of the transistor $Q_4$ is coupled to the main region $MR_2$, and the gate end G of the transistor $Q_2$ is coupled to the scan line $SL_Y$.

When a scan driving circuit 220 drives the scan line $SL_Y$, transistors $Q_1$-$Q_4$ are turned on for the main region $MR_1$ to couple to the data line $DL_X$ via the transistor $Q_1$, the sub region $SR_1$ to couple to the data line $DL_{(X+1)}$ via the transistor $Q_2$, the sub region $SR_2$ to couple to the data line $DL_{(X+2)}$ via the transistor $Q_3$, and the main region $MR_2$ to couple to the data line $DL_{(X+3)}$ via the transistor $Q_4$.

Assume the pixel $PIX_1$ is to display frames corresponding to digital data $DA_1$, and the pixel $PIX_2$ is to display frames corresponding to digital data $DA_2$. For the pixel $PIX_1$, the main region $MR_1$ and the sub region $SR_1$ receive and store gray level voltages corresponding to the digital data $DA_1$ from the data driving circuit 210 via data lines $D_X$ and $D_{(X+1)}$ respectively. For the pixel $PIX_2$, the main region $MR_2$ and the sub region $SR_2$ receive and store gray level voltages corresponding to the digital data $DA_2$ from the data driving circuit 210 via data lines $D_{(X+3)}$ and $D_{(X+2)}$, respectively, for reducing a color offset issue when viewing the pixel driving circuit 200 from different viewing angles.

FIG. 3 illustrates the structure of the data driving circuit 210 utilized to drive the data lines $DL_X$-$DL_{(X+3)}$. Structures of the data driving circuit 210 utilized to drive other data lines can be extrapolated accordingly. The data driving circuit 210 comprises digital-to-analog converters $DAC_1$-$DAC_4$, selecting circuits 211 and 212, data latches $DH_1$-$DH_4$ and level shifters $LS_1$-$LS_4$. The selecting circuit 211 selects the digital data $DA_1$ according to a gamma voltage selecting signal $S_{G_SEL}$ and a polarity signal $S_{POL}$, for inputting the digital data $DA_1$ into two digital-to-analog converters of the digital-to-analog converters $DAC_1$-$DAC_4$, and inputting the digital data $DA_2$ into the other two digital-to-analog converters of the digital-to-analog converters $DAC_1$-$DAC_4$. The data latches $DH_1$-$DH_4$ are for latching digital data outputted by the selecting circuit 211. The level shifters $LS_1$-$LS_4$ are for increasing a voltage level of digital data outputted by the data latches $DH_1$-$DH_4$.

The digital-to-analog converter $DAC_1$ converts the digital data ($DA_1$ or $DA_2$) outputted by the level shifter $LS_1$ to a gray level voltage $V_{G1}$ according to a positive main region gamma voltage $V_{PA}$. The digital-to-analog converter $DAC_2$ converts the digital data ($DA_1$ or $DA_2$) outputted by the level shifter $LS_2$ to a gray level voltage $V_{G2}$ according to a positive sub region gamma voltage $V_{PB}$. The digital-to-analog converter $DAC_3$ converts the digital data ($DA_1$ or $DA_2$) outputted by the level shifter $LS_3$ to a gray level voltage $V_{G3}$ according to a negative sub region gamma voltage $V_{NB}$. The digital-to-analog converter $DAC_4$ converts the digital data ($DA_1$ or $DA_2$) outputted by the level shifter $LS_4$ to a gray level voltage $V_{G4}$ according to a negative main region gamma voltage $V_{NA}$.

The selecting circuit 212 distributes the gray level voltages $V_{G1}$-$V_{G4}$ to the main regions $MR_1$ and $MR_2$ and sub regions $SR_1$ and $SR_2$ via the data lines $DL_X$-$DL_{(X+3)}$ according to the gamma voltage selecting signal $S_{G_SEL}$ and the polarity signal $S_{POL}$. In the data driving circuit 210, the selecting circuit 211 is utilized to input the digital data $DA_1$ (corresponding to the pixel $PIX_1$) and the digital data $DA_2$ (corresponding to the pixel $PIX_2$) into corresponding digital-to-analog converters for generating gray level voltages $V_{G1}$-$V_{G4}$, and the selecting circuit 212 is utilized to distribute the gray level voltages $V_{G1}$-$V_{G4}$ to the main regions $MR_1$ and $MR_2$ and sub regions $SR_1$ and $SR_2$ in pixels $PIX_1$ and $PIX_2$. This way, number of digital-to-analog converters required by the data driving circuit 210 can be reduced. The relative operation principle is further explained below.

The selecting circuit 211 comprises an XOR gate 2111 and multiplexers $MUX_1$-$MUX_4$. The XOR gate 211 performs logic calculations according to the gamma voltage selecting signal $S_{G_SEL}$ and the polarity signal $S_{POL}$ for generating a control signal $S_C$. When the gamma voltage selecting signal $S_{G_SEL}$ and the polarity signal $S_{POL}$, are both logic "0" or "1", the control signal $S_C$ is logic "0"; when the gamma voltage selecting signal $S_{G_SEL}$ is logic "0" and the polarity signal $S_{POL}$ is logic "1", the control signal $S_C$ is logic "1"; and when the gamma voltage selecting signal $S_{G_SEL}$ is logic "1" and the polarity signal $S_{POL}$ is logic "0", the control signal $S_C$ is logic "1".

The multiplexer $MUX_1$ comprises an input end $I_1$ for receiving the digital data $DA_2$, an input end $I_2$ for receiving the digital data $DA_1$ and a control end C for receiving the control signal $S_C$. The multiplexer $MUX_1$ couples the input end $I_1$ or $I_2$ of the multiplexer $MUX_1$ to an output end O of the multiplexer $MUX_1$ according to the control signal $S_C$. The multiplexer $MUX_2$ comprises an input end $I_1$ for receiving the digital data $DA_1$, an input end $I_2$ for receiving the digital data $DA_2$ and a control end C for receiving the control signal $S_C$. The multiplexer $MUX_2$ couples the input end $I_1$ or $I_2$ of the multiplexer $MUX_2$ to an output end O of the multiplexer $MUX_2$ according to the control signal $S_C$. The multiplexer $MUX_3$ comprises an input end $I_1$ for receiving the digital data $DA_2$, an input end $I_2$ for receiving the digital data $DA_1$ and a control end C for receiving the control signal $S_C$. The multiplexer $MUX_3$ couples the input end $I_1$ or $I_2$ of the multiplexer $MUX_3$ to an output end O of the multiplexer $MUX_3$ according to the control signal $S_C$. The multiplexer $MUX_4$ comprises an input end $I_1$ for receiving the digital data $DA_1$, an input end $I_2$ for receiving the digital data $DA_2$ and a control end C for receiving the control signal $S_C$. The multiplexer $MUX_4$ couples the input end $I_1$ or $I_2$ of the multiplexer $MUX_4$ to an output end O of the multiplexer $MUX_4$ according to the control signal $S_C$.

In the present embodiment, when the control signal $S_C$ is logic "0", the input ends $I_1$ of the multiplexers $MUX_1$-$MUX_4$ are coupled to the output ends O of the multiplexers $MUX_1$-$MUX_4$ respectively; and when the control signal $S_C$ is logic "1", the input ends $I_2$ of the multiplexers $MUX_1$-$MUX_4$ are coupled to the output ends O of the multiplexers $MUX_1$-$MUX_4$ respectively.

The data latches $DH_1$-$DH_4$ are coupled between the selecting circuit 211 and level shifters $LS_1$-$LS_4$ respectively. The data latches $DH_1$-$DH_4$ are for latching the digital data outputted from the selecting circuit 211 to the digital-to-analog converters $DAC_1$-$DAC_4$ respectively. The level shifters $LS_1$-$LS_4$ are coupled between the selecting circuit 211 (via the data latches $DH_1$-$DH_4$) and the digital-to-analog converters $DAC_1$-$DAC_4$ respectively. The level shifters $LS_1$-$LS_4$ are for increasing the voltage level of the digital data outputted from the selecting circuit 211 to the digital-to-analog converters $DAC_1$-$DAC_4$ respectively.

The selecting circuit 212 comprises multiplexers $MUX_5$-$MUX_8$, buffers $BUF_1$-$BUF_4$ and polarity selecting circuits 2121 and 2122. The multiplexer $MUX_5$ comprises an input end $I_1$ for receiving the gray level voltage $V_{G2}$, an input end $I_2$ for receiving the gray level voltage $V_{G1}$, a control end C for receiving the control signal $S_C$ and an output end O. The multiplexer $MUX_5$ couples the input end $I_1$ or $I_2$ of the multiplexer $MUX_5$ to the output end O of the multiplexer $MUX_5$ according to the control signal $S_C$. The multiplexer $MUX_6$ comprises an input end $I_1$ for receiving the gray level voltage $V_{G4}$, an input end $I_2$ for receiving the gray level voltage $V_{G3}$, a control end C for receiving the control signal $S_C$ and an output end O. The multiplexer $MUX_6$ couples the input end $I_1$ or $I_2$ of the multiplexer $MUX_6$ to the output end O of the multiplexer $MUX_6$ according to the control signal $S_C$. The multiplexer $MUX_7$ comprises an input end $I_1$ for receiving the gray level voltage $V_{G1}$, an input end $I_2$ for receiving the gray level voltage $V_{G2}$, a control end C for receiving the control signal $S_C$ and an output end O. The multiplexer $MUX_7$ couples the input end $I_1$ or $I_2$ of the multiplexer $MUX_7$ to the output end O of the multiplexer $MUX_7$ according to the control signal $S_C$. The multiplexer $MUX_8$ comprises an input end $I_1$ for receiving the gray level voltage $V_{G3}$, an input end $I_2$ for receiving the gray level voltage $V_{G4}$, a control end C for receiving the control signal $S_C$ and an output end O. The multiplexer $MUX_8$ couples the input end $I_1$ or $I_2$ of the multiplexer $MUX_8$ to the output end O of the multiplexer $MUX_8$ according to the control signal $S_C$.

When the control signal $S_C$ is logic "0", the input ends $I_1$ of the multiplexers $MUX_5$-$MUX_8$ are coupled to the output ends O of the multiplexers $MUX_5$-$MUX_8$ respectively; and when the control signal $S_C$ is logic "1", the input ends $I_2$ of the multiplexers $MUX_5$-$MUX_8$ are coupled to the output ends O of the multiplexers $MUX_5$-$MUX_8$ respectively.

The polarity selecting circuit 2121 comprises an input end $I_1$ coupled to the output end O of the multiplexer $MUX_5$, an input end $I_2$ coupled to the output end O of the multiplexer $MUX_6$, an output end $O_1$ coupled to the data line $DL_X$, an output end $O_2$ coupled to the data line $DL_{(X+1)}$, and a control end C for receiving the polarity signal $S_{POL}$. The polarity selecting circuit 2121 couples one of the input ends $I_1$ and $I_2$ of the polarity selecting circuit 2121 to the output end $O_1$ of the polarity selecting circuit 2121, and couples the other input end to the output end $O_2$ of the polarity selecting circuit 2121, according to the polarity signal $S_{POL}$. The polarity selecting circuit 2122 comprises an input end $I_1$ coupled to the output end O of the multiplexer $MUX_7$, an input end $I_2$ coupled to the output end O of the multiplexer $MUX_8$, an output end $O_1$ coupled to the data line $DL_{(X+2)}$, an output end $O_2$ coupled to the data line $DL_{(X+3)}$, and a control end C for receiving the polarity signal $S_{POL}$. The polarity selecting circuit 2122 couples one of the input ends $I_1$ and $I_2$ of the polarity selecting circuit 2122 to the output end $O_1$ of the polarity selecting circuit 2122, and couples the other input end to the output end $O_2$ of the polarity selecting circuit 2122, according to the polarity signal $S_{POL}$.

When the polarity signal $S_{POL}$ is logic "0", the input ends $I_1$ of the polarity selecting circuits 2121 and 2122 are coupled to the output ends $O_2$ of the polarity selecting circuits 2121 and 2122 respectively, and the input ends $I_2$ of the polarity selecting circuits 2121 and 2122 are coupled to the output ends $O_1$ of the polarity selecting circuits 2121 and 2122 respectively. When the polarity signal $S_{POL}$, is logic "1", the input ends $I_1$ of the polarity selecting circuits 2121 and 2122 are coupled to the output ends $O_1$ of the polarity selecting circuits 2121 and 2122 respectively, and the input ends $I_2$ of the polarity selecting circuits 2121 and 2122 are coupled to the output ends $O_2$ of the polarity selecting circuits 2121 and 2122 respectively.

Buffer $BUF_1$ is coupled between the output end O of the multiplexer $MUX_5$ and the input end $I_1$ of the polarity selecting circuits 2121, for buffering a gray level voltage outputted by the output end O of the multiplexer $MUX_5$. Buffer $BUF_2$ is coupled between the output end O of the multiplexer $MUX_6$ and the input end $I_2$ of the polarity selecting circuits 2121, for buffering a gray level voltage outputted by the output end O of the multiplexer $MUX_6$. Buffer $BUF_3$ is coupled between the output end O of the multiplexer $MUX_7$ and the input end $I_1$ of the polarity selecting circuits 2122, for buffering a gray level voltage outputted by the output end O of the multiplexer $MUX_7$. Buffer $BUF_4$ is coupled between the output end O of the multiplexer $MUX_8$ and the input end $I_2$ of the polarity selecting circuits 2122, for buffering a gray level voltage outputted by the output end O of the multiplexer $MUX_8$.

Figure 4:
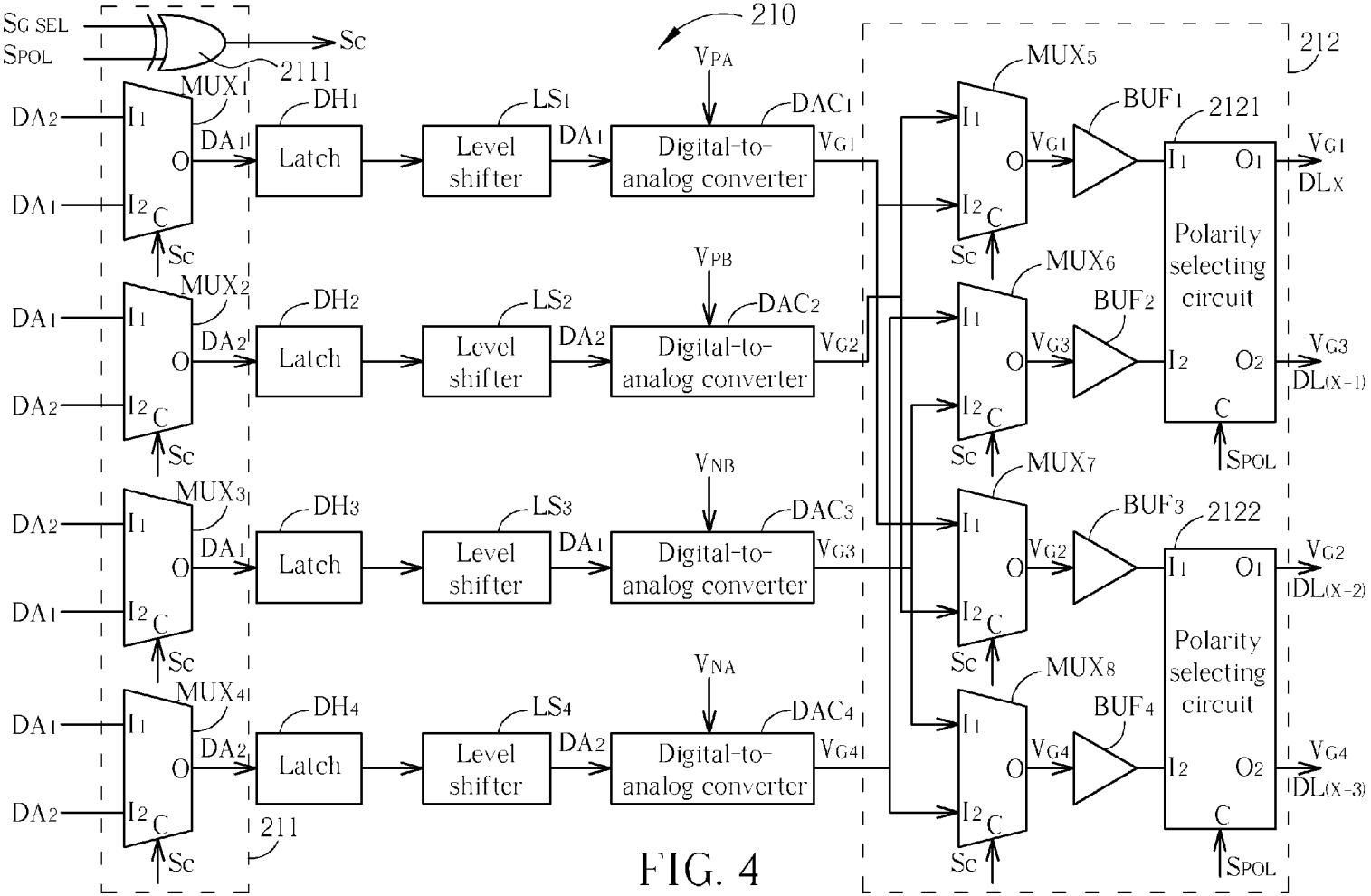
FIG. 4 is a diagram illustrating operation of the data driving circuit when rotating polarities of the main region, the sub region, the sub region and the main region of the pixel driving circuit are positive, negative, positive, and negative respectively.

Please refer to FIG. 4. FIG. 4 is a diagram illustrating operation of the data driving circuit 210 when rotating polarities of the main region $MR_1$, the sub region $SR_1$, the sub region $SR_2$ and the main region $MR_2$ of the pixel driving circuit 200 are positive, negative, positive, and negative respectively. At first, the gamma voltage selecting signal $S_{G_SEL}$ is logic "0" and the polarity signal $S_{POL}$, is logic "1", so the XOR gate 2111 outputs the control signal $S_C$ of logic "1". When the control signal $S_C$ is logic "1", the input ends $I_2$ of the multiplexers $MUX_1$-$MUX_4$ are coupled to the output ends O of the multiplexers $MUX_1$-$MUX_4$ respectively. This way, the multiplexer $MUX_1$ outputs the digital data $DA_1$ to the digital-to-analog converter $DAC_1$ via the data latch $DH_1$ and the level shifter $LS_1$, the multiplexer $MUX_2$ outputs the digital data $DA_2$ to the digital-to-analog converter $DAC_2$ via the data latch $DH_2$ and the level shifter $LS_2$, the multiplexer $MUX_3$ outputs the digital data $DA_1$ to the digital-to-analog converter $DAC_3$ via the data latch $DH_3$ and the level shifter $LS_3$, and the multiplexer $MUX_4$ outputs the digital data $DA_2$ to the digital-to-analog converter $DAC_4$ via the data latch $DH_4$ and the level shifter $LS_4$.

The digital-to-analog converter $DAC_1$ converts the digital data $DA_1$ to the gray level voltage $V_{G1}$ according to the positive main region gamma voltage $V_{PA}$. The digital-to-analog converter $DAC_2$ converts the digital data $DA_2$ to the gray level voltage $V_{G2}$ according to the positive sub region gamma voltage $V_{PB}$. The digital-to-analog converter $DAC_3$ converts the digital data $DA_1$ to the gray level voltage $V_{G3}$ according to the negative sub region gamma voltage $V_{NB}$. The digital-to-analog converter $DAC_4$ converts the digital data $DA_2$ to the gray level voltage $V_{G4}$ according to the negative main region gamma voltage $V_{NA}$. At that moment, the multiplexers $MUX_5$-$MUX_8$ couple the input ends $I_2$ of the multiplexers $MUX_5$-$MUX_8$ to the output ends O of the multiplexers $MUX_5$-$MUX_8$ respectively, according to the control signal $S_C$ at logic "1". This way, the multiplexer $MUX_5$ outputs the gray level voltage $V_{G1}$ to the input end $I_1$ of the polarity selecting circuit 2121 via the buffer $BUF_1$, the multiplexer $MUX_6$ outputs the gray level voltage $V_{G3}$ to the input end $I_2$ of the polarity selecting circuit 2121 via the buffer $BUF_2$, the multiplexer $MUX_7$ outputs the gray level voltage $V_{G2}$ to the input end $I_1$ of the polarity selecting circuit 2122 via the buffer $BUF_3$, and the multiplexer $MUX_8$ outputs the gray level voltage $V_{G4}$ to the input end $I_2$ of the polarity selecting circuit 2122 via the buffer $BUF_4$.

Since the polarity signal $S_{POL}$, is logic "1", the input ends $I_1$ of the polarity selecting circuits 2121 and 2122 are coupled to the output ends $O_1$ of the polarity selecting circuits 2121 and 2122 respectively, and the input ends $I_2$ of the polarity selecting circuits 2121 and 2122 are coupled to the output ends $O_2$ of the polarity selecting circuits 2121 and 2122 respectively. This way, the polarity selecting circuit 2121 outputs the gray level voltage $V_{G1}$ which is obtained from converting the digital data $DA_1$ according to the positive main region gamma voltage $V_{PA}$ to the main region $MR_1$ via the data line $DL_X$, and the polarity selecting circuit 2121 outputs the gray level voltage $V_{G3}$ which is obtained from converting the digital data $DA_1$ according to the negative sub region gamma voltage $V_{NB}$ to the sub region $SR_1$ via the data line $DL_{(X+1)}$. The polarity selecting circuit 2122 outputs the gray level voltage $V_{G2}$ which is obtained from converting the digital data $DA_2$ according to the positive sub region gamma voltage $V_{PB}$ to the sub region $SR_2$ via the data line $DL_{(X+2)}$, and the polarity selecting circuit 2122 outputs the gray level voltage $V_{G4}$ which is obtained from converting the digital data $DA_2$ according to the negative main region gamma voltage $V_{NA}$ to the main region $MR_2$ via the data line $DL_{(X+3)}$.

Therefore, when rotating polarities of the main region $MR_1$, the sub region $SR_1$, the sub region $SR_2$ and the main region $MR_2$ of the pixel driving circuit 200 are positive, negative, positive, and negative respectively, the selecting circuit 211 can be controlled to input the digital data $DA_1$ and $DA_2$ to the corresponding digital-to-analog converters according to the gamma voltage selecting signal $S_{G_SEL}$ at logic "0" and the polarity signal $S_{POL}$, at logic "1", for generating gray level voltages $V_{G1}$-$V_{G4}$, and controlling the selecting circuit 212 to correctly distribute the gray level voltages $V_{G1}$-$V_{G4}$ to the main regions $MR_1$ and $MR_2$ and sub regions $SR_1$ and $SR_2$.

Figure 5:
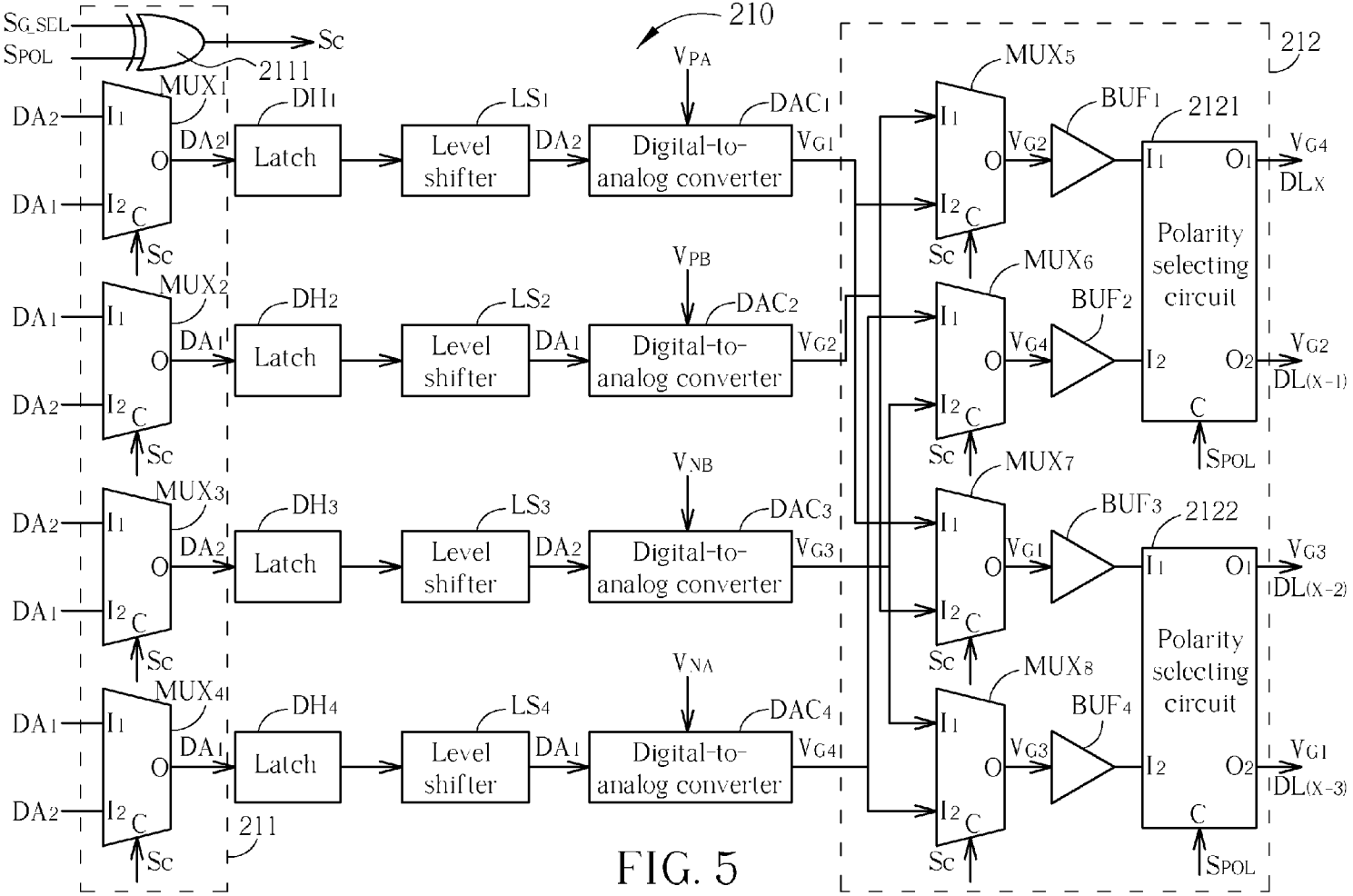
FIG. 5 is a diagram illustrating operation of the data driving circuit when the rotating polarities of the main region, the sub region, the sub region and the main region of the pixel driving circuit are negative, positive, negative and positive respectively.

Please refer FIG. 5. FIG. 5 is a diagram illustrating operation of the data driving circuit 210 when the rotating polarities of the main region $MR_1$, the sub region $SR_1$, the sub region $SR_2$ and the main region $MR_2$ of the pixel driving circuit 200 are negative, positive, negative and positive respectively. At that moment, the gamma voltage selecting signal $S_{G_SEL}$ is logic "0" and the polarity signal $S_{POL}$, is logic "0", so the XOR gate 2111 outputs the control signal $S_C$ of logic "0". When the control signal $S_C$ is logic "0", the input ends $I_1$ of the multiplexers $MUX_1$-$MUX_4$ are coupled to the output ends O of the multiplexers $MUX_1$-$MUX_4$ respectively. This way, the multiplexer $MUX_1$ outputs the digital data $DA_2$ to the digital-to-analog converter $DAC_1$ via the data latch $DH_1$ and the level shifter $LS_1$, the multiplexer $MUX_2$ outputs the digital data $DA_1$ to the digital-to-analog converter $DAC_2$ via the data latch $DH_2$ and the level shifter $LS_2$, the multiplexer $MUX_3$ outputs the digital data $DA_2$ to the digital-to-analog converter $DAC_3$ via the data latch $DH_3$ and the level shifter $LS_3$, and the multiplexer $MUX_4$ outputs the digital data $DA_1$ to the digital-to-analog converter $DAC_4$ via the data latch $DH_4$ and the level shifter $LS_4$.

The digital-to-analog converter $DAC_1$ converts the digital data $DA_2$ to the gray level voltage $V_{G1}$ according to the positive main region gamma voltage $V_{PA}$. The digital-to-analog converter $DAC_2$ converts the digital data $DA_1$ to the gray level voltage $V_{G2}$ according to the positive sub region gamma voltage $V_{PB}$. The digital-to-analog converter $DAC_3$ converts the digital data $DA_2$ to the gray level voltage $V_{G3}$ according to the negative sub region gamma voltage $V_{NB}$. The digital-to-analog converter $DAC_4$ converts the digital data $DA_1$ to the gray level voltage $V_{G4}$ according to the negative main region gamma voltage $V_{NA}$. At that moment, the multiplexers $MUX_5$-$MUX_8$ couple the input ends $I_1$ of the multiplexers $MUX_5$-$MUX_8$ to the output ends O of the multiplexers $MUX_5$-$MUX_8$ respectively, according to the control signal $S_C$ of logic "0". This way, the multiplexer $MUX_5$ outputs the gray level voltage $V_{G2}$ to the input end $I_1$ of the polarity selecting circuit 2121 via the buffer $BUF_1$, the multiplexer $MUX_6$ outputs the gray level voltage $V_{G4}$ to the input end $I_2$ of the polarity selecting circuit 2121 via the buffer $BUF_2$, the multiplexer $MUX_7$ outputs the gray level voltage $V_{G1}$ to the input end $I_1$ of the polarity selecting circuit 2122 via the buffer $BUF_3$, and the multiplexer $MUX_8$ outputs the gray level voltage $V_{G3}$ to the input end $I_2$ of the polarity selecting circuit 2122 via the buffer $BUF_4$.

Since the polarity signal $S_{POL}$ is logic "0" , the input ends $I_1$ of the polarity selecting circuits 2121 and 2122 are coupled to the output ends $O_2$ of the polarity selecting circuits 2121 and 2122 respectively, and the input ends $I_2$ of the polarity selecting circuits 2121 and 2122 are coupled to the output ends $O_1$ of the polarity selecting circuits 2121 and 2122 respectively. This way, the polarity selecting circuit 2121 outputs the gray level voltage $V_{G4}$ which is obtained from converting the digital data $DA_1$ according to the negative main region gamma voltage $V_{NA}$ to the main region $MR_1$ via the data line $DL_X$, and the polarity selecting circuit 2121 outputs the gray level voltage $V_{G2}$ which is obtained from converting the digital data $DA_1$ according to the positive sub region gamma voltage $V_{PB}$ to the sub region $SR_1$ via the data line $DL_{(X+1)}$. The polarity selecting circuit 2122 outputs the gray level voltage $V_{G3}$ which is obtained from converting the digital data $DA_2$ according to the negative sub region gamma voltage $V_{NB}$ to the sub region $SR_2$ via the data line $DL_{(X+2)}$, and the polarity selecting circuit 2122 outputs the gray level voltage $V_{G1}$ which is obtained from converting the digital data $DA_2$ according to the positive main region gamma voltage $V_{PA}$ to the main region $MR_2$ via the data line $DL_{(X+3)}$.

Therefore, when the rotating polarities of the main region $MR_1$, the sub region $SR_1$, the sub region $SR_2$ and the main region $MR_2$ in the pixel driving circuit 200 are negative, positive, negative and positive respectively, the selecting circuit 211 can be controlled to input the digital data $DA_1$ and $DA_2$ to the corresponding digital-to-analog converters according to the gamma voltage selecting signal $S_{G_SEL}$ at logic "0" and the polarity signal $S_{POL}$ at logic "0" for generating gray level voltages $V_{G1}$-$V_{G4}$, and controlling the selecting circuit 212 to correctly distribute the gray level voltages $V_{G1}$-$V_{G4}$ to the main regions $MR_1$ and $MR_2$ and sub regions $SR_1$ and $SR_2$.

Therefore, regarding data lines $DL_X$-$DL_{(X+3)}$ in the pixel driving circuit 200 of the present invention, the data driving circuit 210 only requires four digital-to-analog converters $DAC_1$-$DAC_4$ for providing the correct gray level voltages to the main regions $MR_1$ and $MR_2$ and sub regions $SR_1$ and $SR_2$. In other words, when the pixel driving circuit 200 comprises M data lines, the data driving circuit 210 only requires M digital-to-analog converters. Hence, the pixel driving circuit 200 can reduce the number of digital-to-analog converters required compared to the pixel driving circuit 100 of the prior art, and relative power consumption and cost are reduced.

Figure 6:
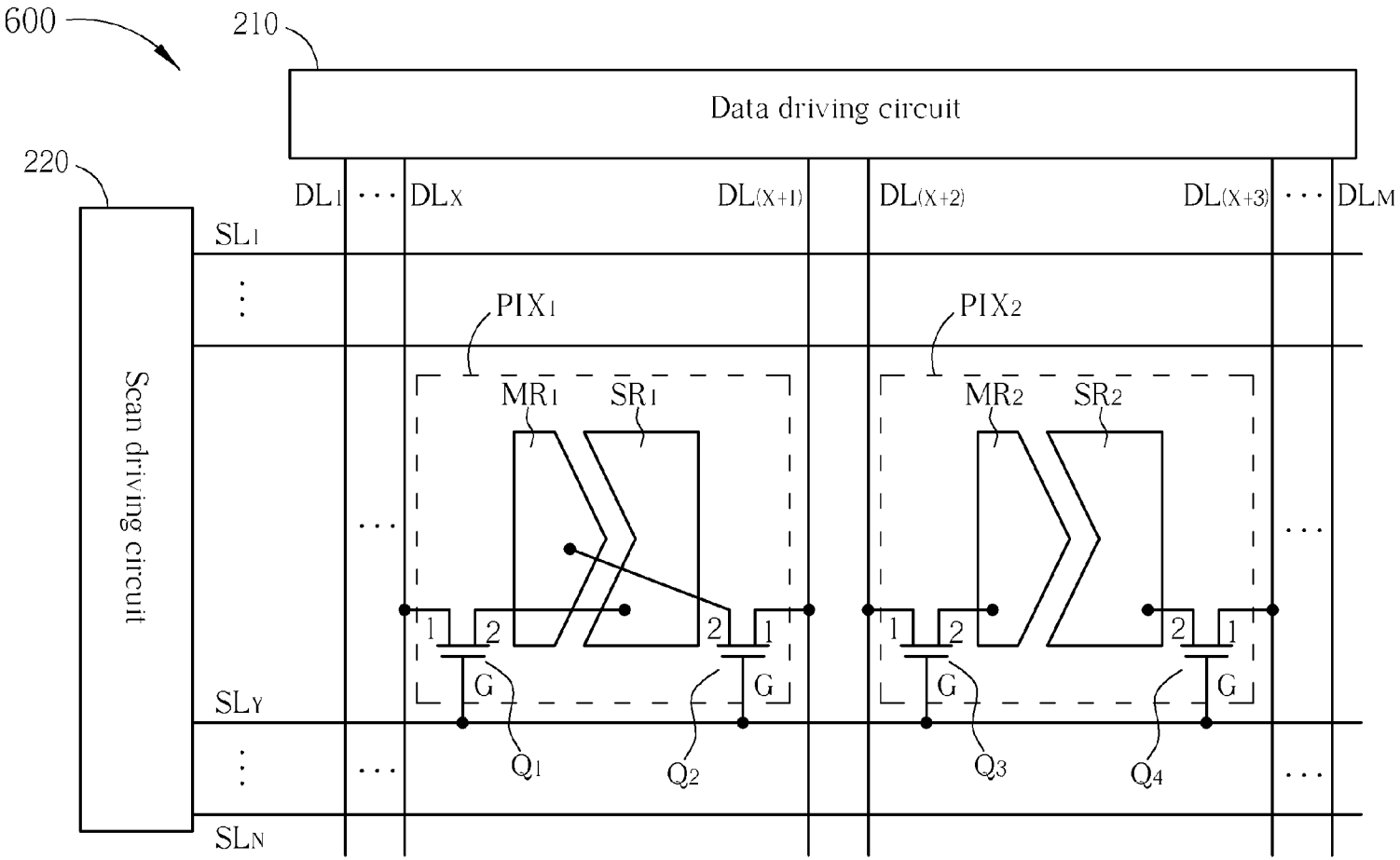
FIG. 6 is a diagram illustrating a pixel driving circuit according to another embodiment of the present invention.

Please refer to FIG. 6. FIG. 6 is a diagram illustrating a pixel driving circuit 600 according to another embodiment of the present invention. The pixel driving circuit 600 is different from the pixel driving circuit 200 in that the second end of the transistor $Q_1$ is coupled to the sub region $SR_1$, the second end of the transistor $Q_2$ is coupled to the main region $MR_1$, the second end of the transistor $Q_3$ is coupled to the main region $MR_2$ and the second end of the transistor $Q_4$ is coupled to the sub region $SR_2$. The data driving circuit 210 can still be utilized to correctly distribute gray level voltages to the main regions $MR_1$ and $MR_2$ and sub regions $SR_1$ and $SR_2$. The relative operation principle is further explained below.

Figure 7:
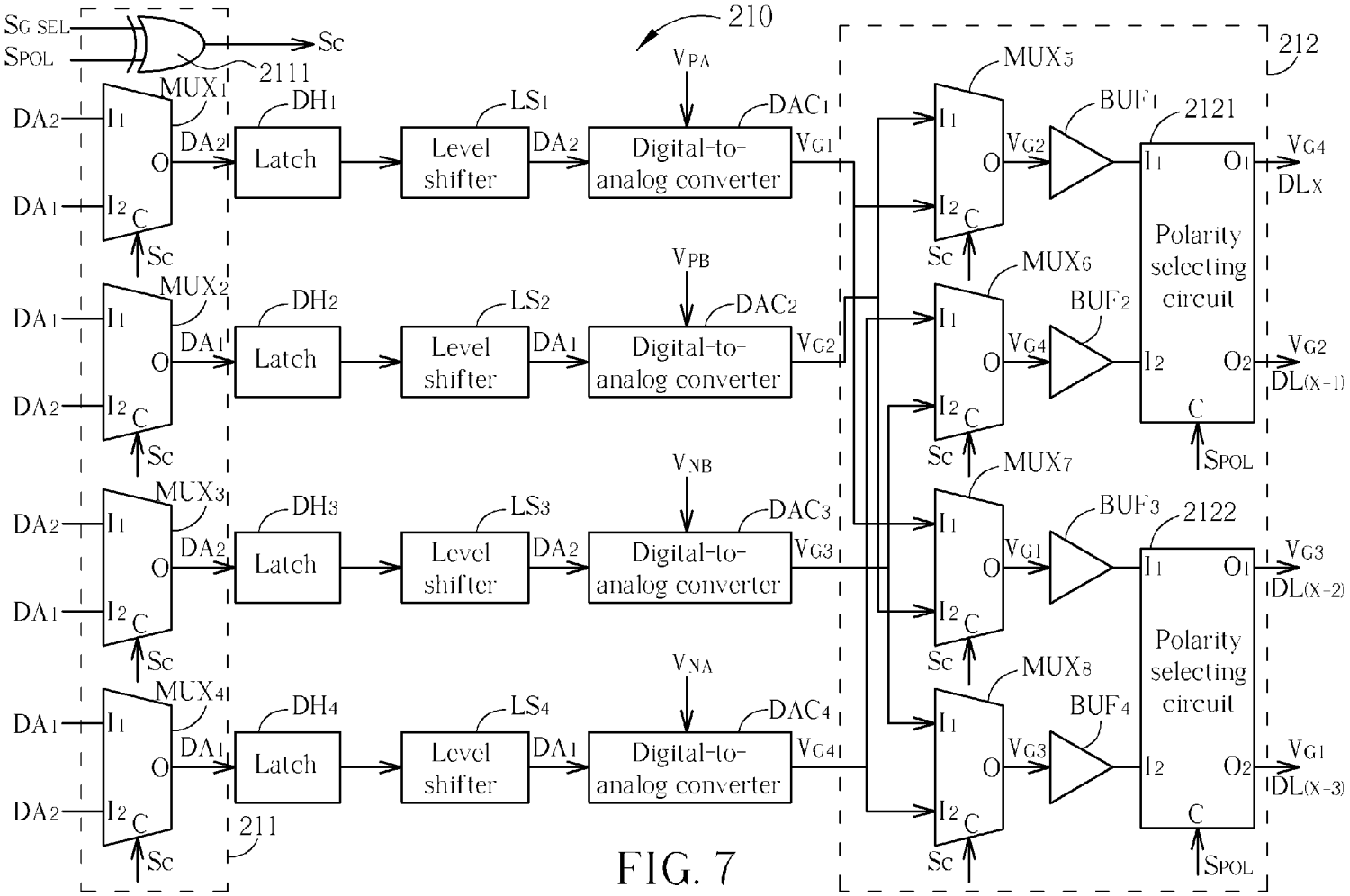
FIG. 7 is a diagram illustrating operation of the data driving circuit when the rotating polarities of the sub region, the main region, the main region and the sub region of the pixel driving circuit are positive, negative, positive, and negative respectively.

Please refer to FIG. 7. FIG. 7 is a diagram illustrating operation of the data driving circuit 210 when the rotating polarities of the sub region $SR_1$, the main region $MR_1$, the main region $MR_2$ and the sub region $SR_2$ of the pixel driving circuit 600 are positive, negative, positive, and negative respectively. At that moment, the gamma voltage selecting signal $S_{G_SEL}$ is logic "1" and the polarity signal $S_{POL}$, is logic "1", so the XOR gate 2111 outputs the control signal $S_C$ of logic "0". When the control signal $S_C$ is logic "0", the input ends $I_1$ of the multiplexers $MUX_1$-$MUX_4$ are coupled to the output ends O of the multiplexers $MUX_1$-$MUX_4$ respectively. This way, the multiplexer $MUX_1$ outputs the digital data $DA_2$ to the digital-to-analog converter $DAC_1$ via the data latch $DH_1$ and the level shifter $LS_1$, the multiplexer $MUX_2$ outputs the digital data $DA_1$ to the digital-to-analog converter $DAC_2$ via the data latch $DH_2$ and the level shifter $LS_2$, the multiplexer $MUX_3$ outputs the digital data $DA_2$ to the digital-to-analog converter $DAC_3$ via the data latch $DH_3$ and the level shifter $LS_3$, and the multiplexer $MUX_4$ outputs the digital data $DA_1$ to the digital-to-analog converter $DAC_4$ via the data latch $DH_4$ and the level shifter $LS_4$.

The digital-to-analog converter $DAC_1$ converts the digital data $DA_2$ to the gray level voltage $V_{G1}$ according to the positive main region gamma voltage $V_{PA}$. The digital-to-analog converter $DAC_2$ converts the digital data $DA_1$ to the gray level voltage $V_{G2}$ according to the positive sub region gamma voltage $V_{PB}$. The digital-to-analog converter $DAC_3$ converts the digital data $DA_2$ to the gray level voltage $V_{G3}$ according to the negative sub region gamma voltage $V_{NB}$. The digital-to-analog converter $DAC_4$ converts the digital data $DA_1$ to the gray level voltage $V_{G4}$ according to the negative main region gamma voltage $V_{NA}$. At that moment, the multiplexers $MUX_5$-$MUX_8$ couple the input ends $I_1$ of the multiplexers $MUX_5$-$MUX_8$ to the output ends O of the multiplexers $MUX_5$-$MUX_8$, respectively, according to the control signal $S_C$ of logic "0". This way, the multiplexer $MUX_5$ outputs the gray level voltage $V_{G2}$ to the input end $I_1$ of the polarity selecting circuit 2121 via the buffer $BUF_1$, the multiplexer $MUX_6$ outputs the gray level voltage $V_{G4}$ to the input end $I_2$ of the polarity selecting circuit 2121 via the buffer $BUF_2$, the multiplexer $MUX_7$ outputs the gray level voltage $V_{G1}$ to the input end $I_1$ of the polarity selecting circuit 2122 via the buffer $BUF_3$, and the multiplexer $MUX_8$ outputs the gray level voltage $V_{G3}$ to the input end $I_2$ of the polarity selecting circuit 2122 via the buffer $BUF_4$.

Since the polarity signal $S_{POL}$, is logic "1", the input ends $I_1$ of the polarity selecting circuits 2121 and 2122 are coupled to the output ends $O_1$ of the polarity selecting circuits 2121 and 2122 respectively, and the input ends $I_2$ of the polarity selecting circuits 2121 and 2122 are coupled to the output ends $O_2$ of the polarity selecting circuits 2121 and 2122 respectively. This way, the polarity selecting circuit 2121 outputs the gray level voltage $V_{G2}$ which is obtained from converting the digital data $DA_2$ according to the positive sub region gamma voltage $V_{PB}$ to the sub region $SR_1$ via the data line $DL_X$, and the polarity selecting circuit 2121 outputs the gray level voltage $V_{G4}$ which is obtained from converting the digital data $DA_1$ according to the negative main region gamma voltage $V_{NA}$ to the main region $MR_1$ via the data line $DL_{(X+1)}$. The polarity selecting circuit 2122 outputs the gray level voltage $V_{G1}$ which is obtained from converting the digital data $DA_2$ according to the positive main region gamma voltage $V_{PA}$ to the sub region $MR_2$ via the data line $DL_{(X+2)}$, and the polarity selecting circuit 2122 outputs the gray level voltage $V_{G3}$ which is obtained from converting the digital data $DA_2$ according to the negative sub region gamma voltage $V_{NB}$ to the sub region $SR_2$ via the data line $DL_{(X+3)}$.

Therefore, when the rotating polarities of the sub region $SR_1$, the main region $MR_1$, the main region $MR_2$ and the sub region $SR_2$ of the pixel driving circuit 600 are positive, negative, positive and negative respectively, the selecting circuit 211 can be controlled to input the digital data $DA_1$ and $DA_2$ to the corresponding digital-to-analog converters according to the gamma voltage selecting signal $S_{G_SEL}$ at logic "1" and the polarity signal $S_{POL}$ at logic "1" for generating gray level voltages $V_{G1}$-$V_{G4}$, and controlling the selecting circuit 212 to correctly distribute the gray level voltages $V_{G1}$-$V_{G4}$ to the main regions $MR_1$ and $MR_2$ and sub regions $SR_1$ and $SR_2$.

Figure 8:
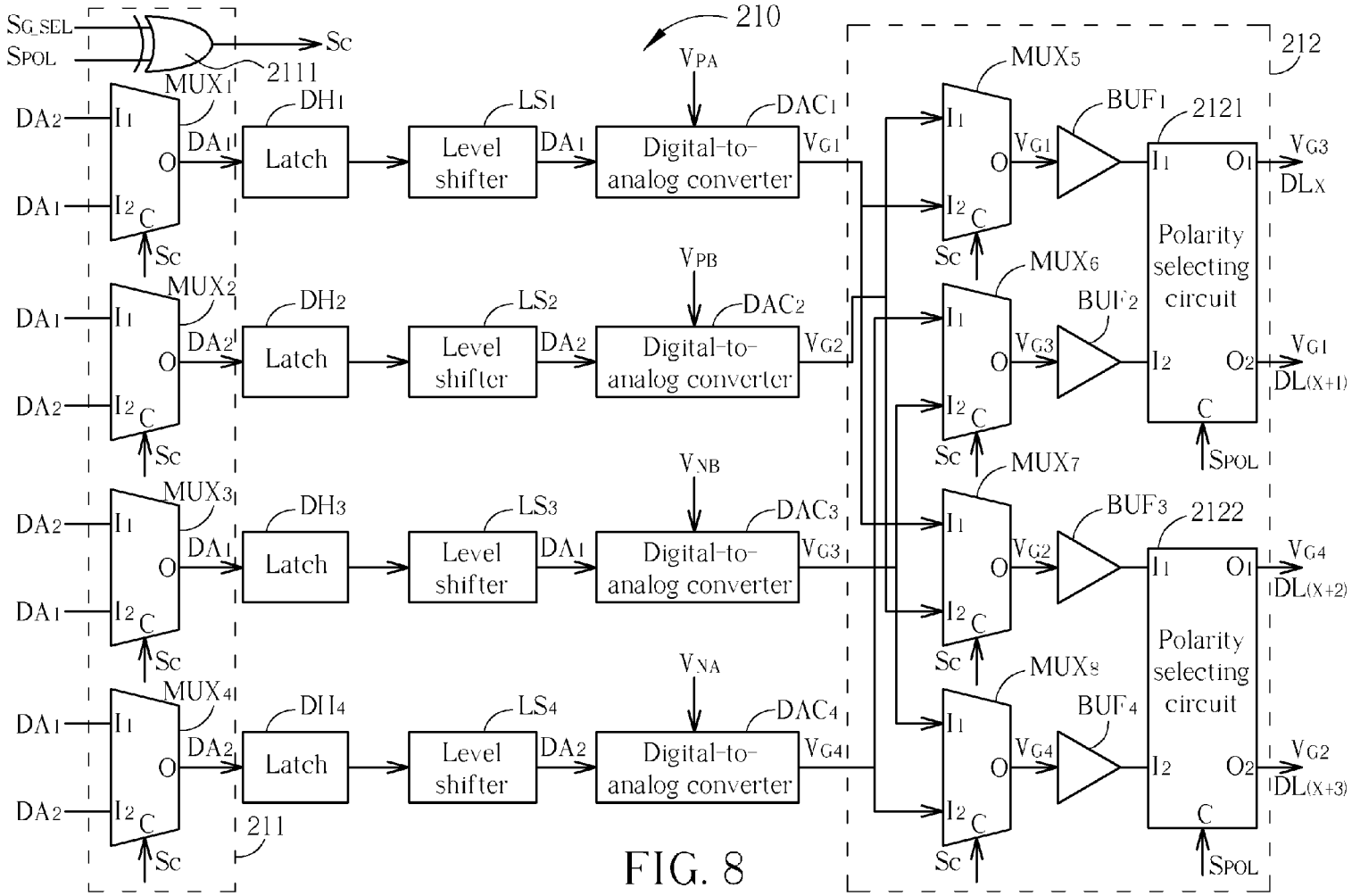
FIG. 8 is a diagram illustrating operation of the data driving circuit when the rotating polarities of the sub region, the main region, the main region and the sub region of the pixel driving circuit are negative, positive, negative and positive respectively.

Please refer to FIG. 8. FIG. 8 is a diagram illustrating operation of the data driving circuit 210 when the rotating polarities of the sub region $SR_1$, the main region $MR_1$, the main region $MR_2$ and the sub region $SR_2$ of the pixel driving circuit 600 are negative, positive, negative and positive respectively. At that moment, the gamma voltage selecting signal $S_{G_SEL}$ is logic "1" and the polarity signal $S_{POL}$, is logic "0", so the XOR gate 2111 outputs the control signal $S_C$ of logic "1". When the control signal $S_C$ is logic "1", the input ends $I_2$ of the multiplexers $MUX_1$-$MUX_4$ are coupled to the output ends O of the multiplexers $MUX_1$-$MUX_4$ respectively. This way, the multiplexer $MUX_1$ outputs the digital data $DA_1$ to the digital-to-analog converter $DAC_1$ via the data latch $DH_1$ and the level shifter $LS_1$, the multiplexer $MUX_2$ outputs the digital data $DA_2$ to the digital-to-analog converter $DAC_2$ via the data latch $DH_2$ and the level shifter $LS_2$, the multiplexer $MUX_3$ outputs the digital data $DA_1$ to the digital-to-analog converter $DAC_3$ via the data latch $DH_3$ and the level shifter $LS_3$, and the multiplexer $MUX_4$ outputs the digital data $DA_2$ to the digital-to-analog converter $DAC_4$ via the data latch $DH_4$ and the level shifter $LS_4$.

The digital-to-analog converter $DAC_1$ converts the digital data $DA_1$ to the gray level voltage $V_{G1}$ according to the positive main region gamma voltage $V_{PA}$. The digital-to-analog converter $DAC_2$ converts the digital data $DA_2$ to the gray level voltage $V_{G2}$ according to the positive sub region gamma voltage $V_{PB}$. The digital-to-analog converter $DAC_3$ converts the digital data $DA_1$ to the gray level voltage $V_{G3}$ according to the negative sub region gamma voltage $V_{NB}$. The digital-to-analog converter $DAC_4$ converts the digital data $DA_2$ to the gray level voltage $V_{G4}$ according to the negative main region gamma voltage $V_{NA}$. At that moment, the multiplexers $MUX_5$-$MUX_8$ couple the input ends $I_2$ of the multiplexers $MUX_5$-$MUX_8$ to the output ends O of the multiplexers $MUX_5$-$MUX_8$, respectively, according to the control signal $S_C$ at logic "1". This way, the multiplexer $MUX_5$ outputs the gray level voltage $V_{G1}$ to the input end $I_1$ of the polarity selecting circuit 2121 via the buffer $BUF_1$, the multiplexer $MUX_6$ outputs the gray level voltage $V_{G3}$ to the input end $I_2$ of the polarity selecting circuit 2121 via the buffer $BUF_2$, the multiplexer $MUX_7$ outputs the gray level voltage $V_{G2}$ to the input end $I_1$ of the polarity selecting circuit 2122 via the buffer $BUF_3$, and the multiplexer $MUX_8$ outputs the gray level voltage $V_{G4}$ to the input end $I_2$ of the polarity selecting circuit 2122 via the buffer $BUF_4$.

Since the polarity signal $S_{POL}$ is logic "0", the input ends $I_1$ of the polarity selecting circuits 2121 and 2122 are coupled to the output ends $O_2$ of the polarity selecting circuits 2121 and 2122 respectively, and the input ends $I_2$ of the polarity selecting circuits 2121 and 2122 are coupled to the output ends $O_1$ of the polarity selecting circuits 2121 and 2122 respectively. This way, the polarity selecting circuit 2121 outputs the gray level voltage $V_{G3}$ which is obtained from converting the digital data $DA_1$ according to the negative sub region gamma voltage $V_{NB}$ to the sub region $SR_1$ via the data line $DL_X$, and the polarity selecting circuit 2121 outputs the gray level voltage $V_{G1}$ which is obtained from converting the digital data $DA_1$ according to the positive main region gamma voltage $V_{PA}$ to the main region $MR_1$ via the data line $DL_{(X+1)}$. The polarity selecting circuit 2122 outputs the gray level voltage $V_{G4}$ which is obtained from converting the digital data $DA_2$ according to the negative main region gamma voltage $V_{NA}$ to the sub region $MR_2$ via the data line $DL_{(X+2)}$, and the polarity selecting circuit 2122 outputs the gray level voltage $V_{G2}$ which is obtained from converting the digital data $DA_2$ according to the positive sub region gamma voltage $V_{PB}$ to the sub region $SR_2$ via the data line $DL_{(X+3)}$.

Therefore, when the rotating polarities of the sub region $SR_1$, the main region $MR_1$, the main region $MR_2$ and the sub region $SR_2$ of the pixel driving circuit 600 are negative, positive, negative and positive respectively, the selecting circuit 211 can be controlled to input the digital data $DA_1$ and $DA_2$ to the corresponding digital-to-analog converters according to the gamma voltage selecting signal $S_{G_SEL}$ of logic "1" and the polarity signal $S_{POL}$ at logic "0" for generating gray level voltages $V_{G1}$-$V_{G4}$, and controlling the selecting circuit 212 to correctly distribute the gray level voltages $V_{G1}$-$V_{G4}$ to the main regions $MR_1$ and $MR_2$ and sub regions $SR_1$ and $SR_2$.

Similarly, regarding data lines $DL_X$-$DL_{(X+3)}$ in the pixel driving circuit 600 of the present invention, the data driving circuit 210 only requires four digital-to-analog converters $DAC_1$-$DAC_4$ for providing the correct gray level voltages to the main regions $MR_1$ and $MR_2$ and sub regions $SR_1$ and $SR_2$. In other words, when the pixel driving circuit 600 comprises M data lines, the data driving circuit 210 only requires M digital-to-analog converters. Hence, the pixel driving circuit 600 can reduce the number of digital-to-analog converters required compared to the pixel driving circuit 100 of the prior art, and relative power consumption and cost are reduced.

Figure 9:
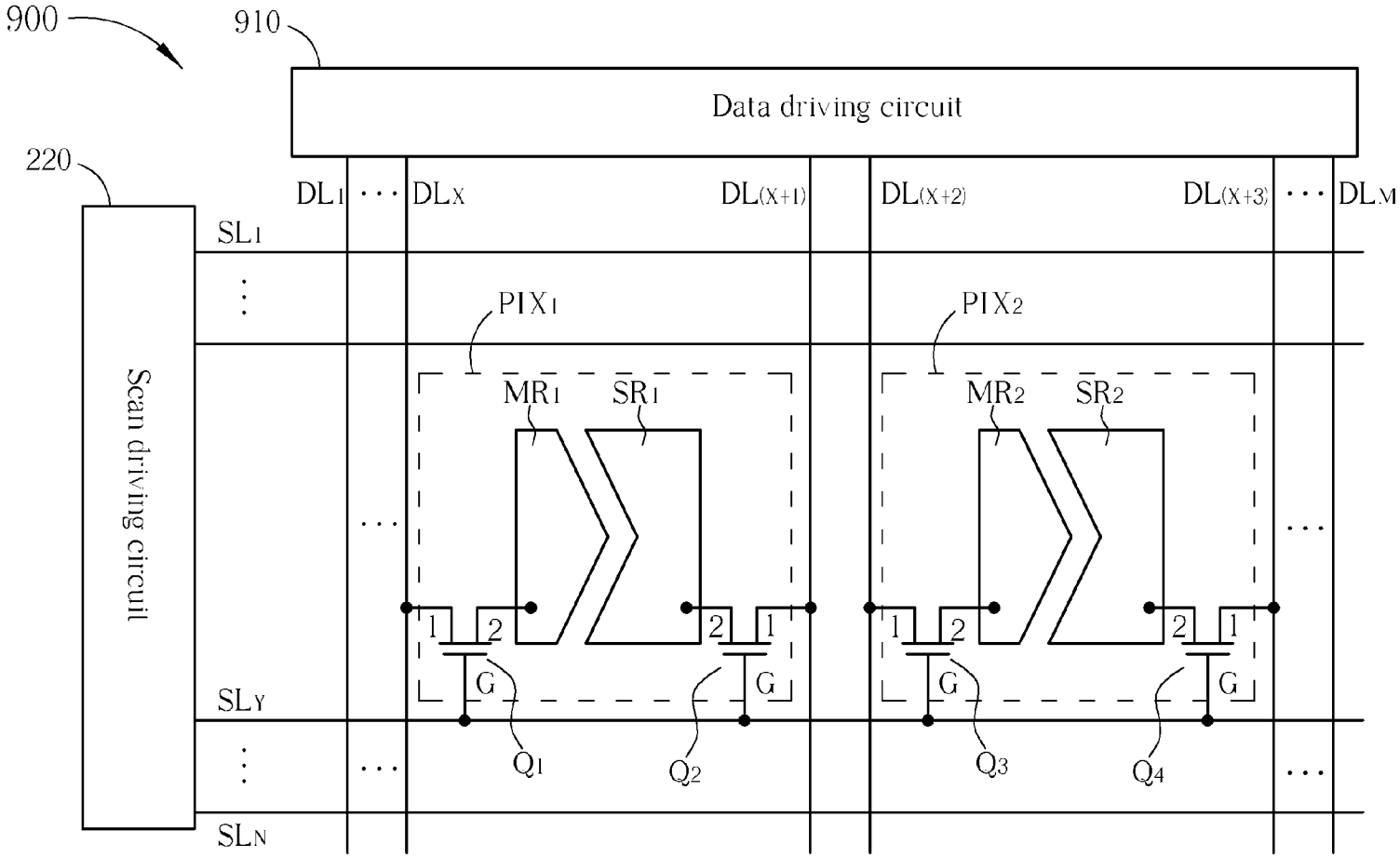
FIG. 9 is a diagram illustrating a pixel driving circuit according to another embodiment of the present invention.
Figure 10:
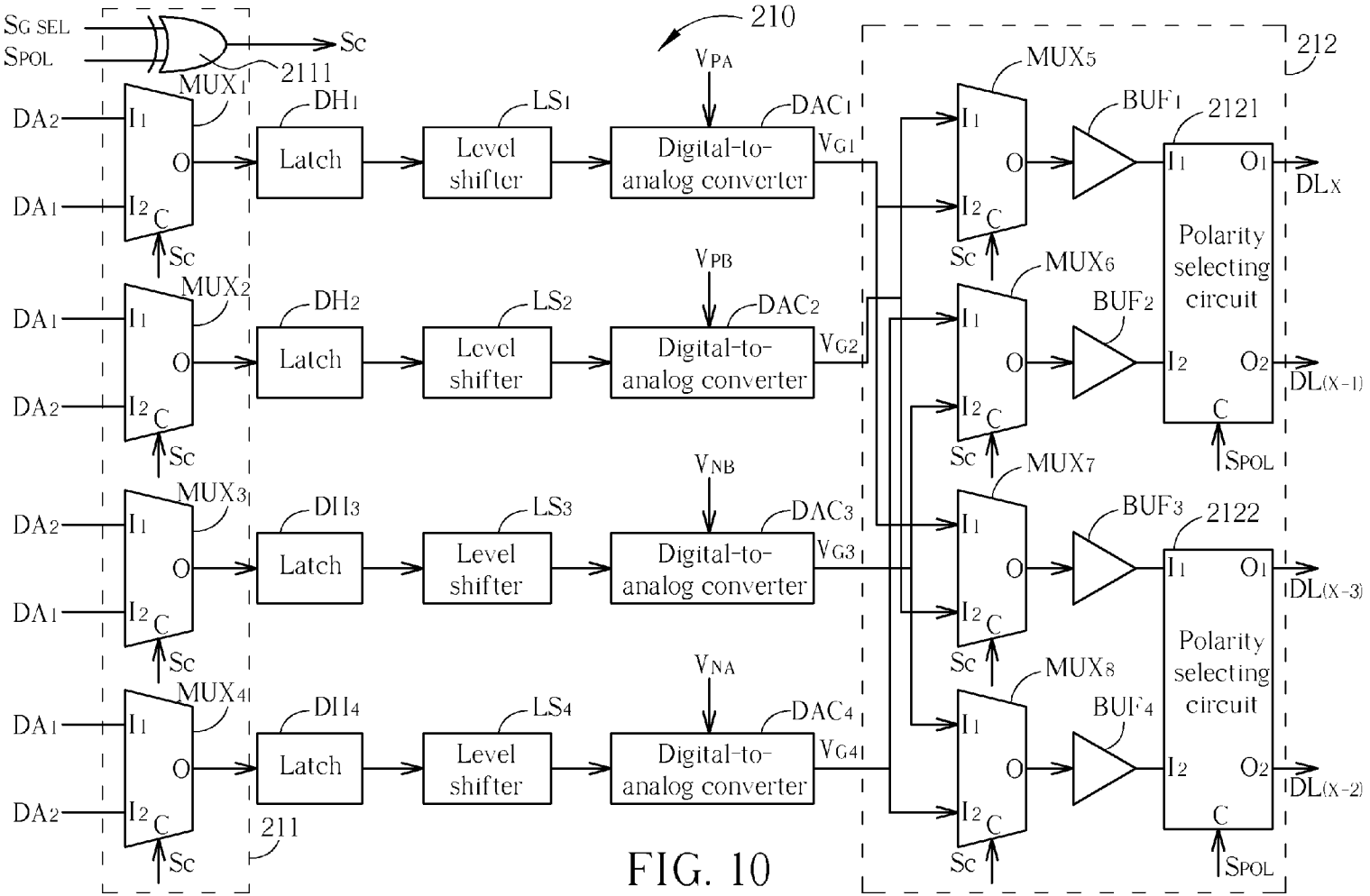
FIG. 10 is a diagram illustrating a partial structure of a data driving circuit of the pixel driving circuit of the present invention.

Furthermore, coupling relations between pixels and data lines are not limited to those shown in FIG. 2 or FIG. 6. For instance, please refer to FIG. 9 and FIG. 10. FIG. 9 is a diagram illustrating a pixel driving circuit 900 according to another embodiment of the present invention. FIG. 10 is a diagram illustrating a partial structure of a data driving circuit 910 of the pixel driving circuit 900 of the present invention. Compared to the pixel driving circuit 200, in the pixel driving circuit 900 the main region $MR_1$ is coupled to the data line $DL_X$ via the transistor $Q_1$, the sub region $SR_1$ is coupled to the data line $_{DL}(_{X+1})$ via the transistor $Q_2$, the main region $MR_2$ is coupled to the data line $DL_{(X+2)}$ via the transistor $Q_3$ and the sub region $SR_2$ is coupled to the data line $DL_{(X+3)}$ via the transistor $Q_4$.

As shown in FIG. 10, the data driving circuit 901 is different from the data driving circuit 210 in that the output end $O_1$ of the polarity selecting circuit 2122 is coupled to the data line $DL(_{X+3})$ and the output end $O_2$ of the polarity selecting circuit 2122 is coupled to the data line $DL_{(X+2)}$. This way, for either pixel driving circuit 200 or 900, the output end $O_1$ of the polarity selecting circuit 2122 is coupled to the sub region $SR_2$, and the output end $O_2$ of the polarity selecting circuit 2122 is coupled to the main region $MR_2$. Therefore, the data driving circuit 901 can distribute correct gray level voltages $V_{G1}$-$V_{G4}$ to the main regions $MR_1$ and $MR_2$ and sub regions $SR_1$ and $SR_2$ according to methods explained in FIG. 4 and FIG. 5. In other words, even if the coupling relationships between pixels and data lines are changed in the pixel driving circuit, as long as the structure of the data driving circuit is adjusted correspondingly, the data driving circuit can still distribute correct gray level voltages to the main regions and the sub regions of each pixel.

In summary, the pixel driving circuit provided in the present invention comprises a first pixel, a second pixel, and a data-driving circuit. Each pixel comprises a main region and a sub region. The main region stores a gray level voltage and the sub region stores a gray level voltage corresponding to the gray level voltage stored in the main region when the main region and the sub region display images. In the data driving circuit, a first, a second, a third, and a fourth gray level voltage are generated by means of a first selecting circuit outputting first digital data corresponding to the first pixel and second digital data corresponding to the second pixel to the corresponding digital-to-analog converters, respectively. The first, the second, the third, and the fourth gray level voltages are distributed to the main and sub regions of the first and second pixels by a second selecting circuit. This way, the number of digital-to-analog converters required by the data driving circuit can be reduced, and the cost and power consumption of the pixel driving circuit are reduced.

Those skilled in the art will readily observe that numerous modifications and alterations of the device and method may be made while retaining the teachings of the invention.

Accordingly, the above disclosure should be construed as limited only by the metes and bounds of the appended claims.

What is claimed is:

1. A pixel driving circuit, comprising:

a first pixel, comprising a first main region and a first sub region, wherein the first main region is coupled to a first data line and a scan line, the first sub region is coupled to a second data line and the scan line, and each of the first main region and the first sub region stores a gray level voltage corresponding to first digital data;

a second pixel, comprising a second main region and a second sub region, wherein the second sub region is coupled to a third data line and the scan line, the second main region is coupled to a fourth data line and the scan line, and each of the second main region and the second sub region stores a gray level voltage corresponding to second digital data; and a data driving circuit, comprising:

a first digital-to-analog converter, for converting the first digital data or the second digital data to a first gray level voltage according to a positive main region gamma voltage;

a second digital-to-analog converter, for converting the first digital data or the second digital data to a second gray level voltage according to a positive sub region gamma voltage;

a third digital-to-analog converter, for converting the first digital data or the second digital data to a third gray level voltage according to a negative sub region gamma voltage;

a fourth digital-to-analog converter, for converting the first digital data or the second digital data to a fourth gray level voltage according to a negative main region gamma voltage;

a first selecting circuit, for simultaneously distributing the first digital data and the second digital data according to a gamma voltage selecting signal and a polarity signal such that the first digital data is inputted into two digital-to-analog converters of the first, the second, the third and the fourth digital-to-analog converters while the second digital data is inputted into the other two digital-to-analog converters of the first, the second, the third and the fourth digital-to-analog converters; and a second selecting circuit, for distributing the first, the second, the third and the fourth gray level voltages to the first main region, the second main region, the first sub region and the second sub region via the first, the second, the third and the fourth data lines, according to the gamma voltage selecting signal and the polarity signal.

2. The pixel driving circuit of claim 1, wherein the data driving circuit further comprises:

a first level shifter, coupled between the first selecting circuit and the first digital-to-analog converter;

a second level shifter, coupled between the first selecting circuit and the second digital-to-analog converter;

a third level shifter, coupled between the first selecting circuit and the third digital-to-analog converter; and a fourth level shifter, coupled between the first selecting circuit and the fourth digital-to-analog converter.

3. The pixel driving circuit of claim 1, wherein the data driving circuit further comprises:

a first data latch, coupled between the first selecting circuit and the first level shifter;

a second data latch, coupled between the first selecting circuit and the second level shifter;

a third data latch, coupled between the first selecting circuit and the third level shifter; and a fourth data latch, coupled between the first selecting circuit and the fourth level shifter.

4. The pixel driving circuit of claim 1, wherein:

when both of the gamma voltage selecting signal and the polarity signal are a first predetermined logic or a second predetermined logic, the first selecting circuit outputs the second digital data to the first and the third digital-to-analog converters, and the first selecting circuit outputs the first digital data to the second and the fourth digital-to-analog converters;

when the gamma voltage selecting signal is the first predetermined logic and the polarity signal is the second predetermined logic, the first selecting circuit outputs the first digital data to the first and the third digital-to-analog converters, and the first selecting circuit outputs the second digital data to the second and the fourth digital-to-analog converters; and when the gamma voltage selecting signal is the second predetermined logic and the polarity signal is the first predetermined logic, the first selecting circuit outputs the first digital data to the first and the third digital-to-analog converters, and the first selecting circuit outputs the second digital data to the second and the fourth digital-to-analog converters.

5. The pixel driving circuit of claim 4, wherein the first selecting circuit comprises:

an XOR gate, for generating a control signal according to the gamma voltage selecting signal and the polarity signal;

a first multiplexer, comprising a first input end for receiving the second digital data, a second input end for receiving the first digital data, a control end for receiving the control signal and an output end, wherein the first multiplexer is for coupling the first input end or the second input end of the first multiplexer to the output end of the first multiplexer according to the control signal;

a second multiplexer, comprising a first input end for receiving the first digital data, a second input end for receiving the second digital data, a control end for receiving the control signal and an output end, wherein the second multiplexer is for coupling the first input end or the second input end of the second multiplexer to the output end of the second multiplexer according to the control signal;

a third multiplexer, comprising a first input end for receiving the second digital data, a second input end for receiving the first digital data, a control end for receiving the control signal and an output end, wherein the third multiplexer is for coupling the first input end or the second input end of the third multiplexer to the output end of the third multiplexer according to the control signal; and a fourth multiplexer, comprising a first input end for receiving the first digital data, a second input end for receiving the second digital data, a control end for receiving the control signal and an output end, wherein the fourth multiplexer is for coupling the first input end or the second input end of the fourth multiplexer to the output end of the fourth multiplexer according to the control signal.

6. The pixel driving circuit of claim 5, wherein:

when both of the gamma voltage selecting signal and the polarity signal are the first predetermined logic or the second predetermined logic, the control signal is the first predetermined logic;

when the gamma voltage selecting signal is the first predetermined logic and the polarity signal is the second predetermined logic, the control signal is the second predetermined logic; and when the gamma voltage selecting signal is the second predetermined logic and the polarity signal is the first predetermined logic, the control signal is the second predetermined logic.

7. The pixel driving circuit of claim 6, wherein:

when the control signal is the first predetermined logic, the first input end of the first multiplexer is coupled to the output end of the first multiplexer, the first input end of the second multiplexer is coupled to the output end of the second multiplexer, the first input end of the third multiplexer is coupled to the output end of the third multiplexer, and the first input end of the fourth multiplexer is coupled to the output end of the fourth multiplexer; and when the control signal is the second predetermined logic, the second input end of the first multiplexer is coupled to the output end of the first multiplexer, the second input end of the second multiplexer is coupled to the output end of the second multiplexer, the second input end of the third multiplexer is coupled to the output end of the third multiplexer, and the second input end of the fourth multiplexer is coupled to the output end of the fourth multiplexer.

8. The pixel driving circuit of claim 6, wherein the second selecting circuit comprises:

a fifth multiplexer, comprising a first input end for receiving the second gray level voltage, a second input end for receiving the first gray level voltage, a control end for receiving the control signal and an output end, wherein the fifth multiplexer is for coupling the first input end or the second input end of the fifth multiplexer to the output end of the fifth multiplexer according to the control signal;

a sixth multiplexer, comprising a first input end for receiving the fourth gray level voltage, a second input end for receiving the third gray level voltage, a control end for receiving the control signal and an output end, wherein the sixth multiplexer is for coupling the first input end or the second input end of the sixth multiplexer to the output end of the sixth multiplexer according to the control signal;

a seventh multiplexer, comprising a first input end for receiving the first gray level voltage, a second input end for receiving the second gray level voltage, a control end for receiving the control signal and an output end, wherein the seventh multiplexer is for coupling the first input end or the second input end of the seventh multiplexer to the output end of the seventh multiplexer according to the control signal;

an eighth multiplexer, comprising a first input end for receiving the third gray level voltage, a second input end for receiving the fourth gray level voltage, a control end for receiving the control signal and an output end, wherein the eighth multiplexer is for coupling the first input end or the second input end of the eighth multiplexer to the output end of the eighth multiplexer according to the control signal;

a first polarity selecting circuit, comprising a first input end coupled to the output end of the fifth multiplexer, a second input end coupled to the output end of the sixth multiplexer, a first output end, a second output end, and a control end for receiving the polarity signal, wherein the first polarity selecting circuit is for coupling one input end of the first input end and the second input end of the first polarity selecting circuit to the first output end of the first polarity selecting circuit, and coupling the other input end to the second output end of the first polarity selecting circuit according to the polarity signal; and a second polarity selecting circuit, comprising a first input end coupled to the output end of the seventh multiplexer, a second input end coupled to the output end of the eighth multiplexer, a first output end, a second output end, and a control end for receiving the polarity signal, wherein the second polarity selecting circuit is for coupling one input end of the first input end and the second input end of the second polarity selecting circuit to the first output end of the second polarity selecting circuit, and coupling the other input end to the second output end of the second polarity selecting circuit according to the polarity signal.

9. The pixel driving circuit of claim 8, wherein:

when the control signal is the first predetermined logic, the first input end of the fifth multiplexer is coupled to the output end of the fifth multiplexer, the first input end of the sixth multiplexer is coupled to the output end of the sixth multiplexer, the first input end of the seventh multiplexer is coupled to the output end of the seventh multiplexer, and the first input end of the eighth multiplexer is coupled to the output end of the eighth multiplexer; and when the control signal is the second predetermined logic, the second input end of the fifth multiplexer is coupled to the output end of the fifth multiplexer, the second input end of the sixth multiplexer is coupled to the output end of the sixth multiplexer, the second input end of the seventh multiplexer is coupled to the output end of the seventh multiplexer, and the second input end of the eighth multiplexer is coupled to the output end of the eighth multiplexer.

10. The pixel driving circuit of claim 8, wherein:

when the polarity signal is the first predetermined logic, the first input end of the first polarity selecting circuit is coupled to the second output end of the first polarity selecting circuit, the second input end of the first polarity selecting circuit is coupled to the first output end of the first polarity selecting circuit, the first input end of the second polarity selecting circuit is coupled to the second output end of the second polarity selecting circuit, and the second input end of the second polarity selecting circuit is coupled to the first output end of the second polarity selecting circuit; and when the polarity signal is the second predetermined logic, the first input end of the first polarity selecting circuit is coupled to the first output end of the first polarity selecting circuit, the second input end of the first polarity selecting circuit is coupled to the second output end of the first polarity selecting circuit, the first input end of the second polarity selecting circuit is coupled to the first output end of the second polarity selecting circuit, and the second input end of the second polarity selecting circuit is coupled to the second output end of the second polarity selecting circuit.

11. The pixel driving circuit of claim 8, wherein the second selecting circuit further comprises:

a first buffer, coupled between the output end of the fifth multiplexer and the first input end of the first polarity selecting circuit, wherein the first buffer is for buffering a gray level voltage outputted by the output end of the fifth multiplexer;

a second buffer, coupled between the output end of the sixth multiplexer and the second input end of the first polarity selecting circuit, wherein the second buffer is for buffering a gray level voltage outputted by the output end of the sixth multiplexer;

a third buffer, coupled between the output end of the seventh multiplexer and the first input end of the second polarity selecting circuit, wherein the third buffer is for buffering a gray level voltage outputted by the output end of the seventh multiplexer; and a fourth buffer, coupled between the output end of the eighth multiplexer and the second input end of the second polarity selecting circuit, wherein the fourth buffer is for buffering a gray level voltage outputted by the output end of the eighth multiplexer.

12. The pixel driving circuit of claim 8, wherein the first output end of the first polarity selecting circuit is coupled to the first data line, the second output end of the first polarity selecting circuit is coupled to the second data line, the first output end of the second polarity selecting circuit is coupled to the third data line, and the second output end of the second polarity selecting circuit is coupled to the fourth data line.

13. The pixel driving circuit of claim 12, wherein:

when the gamma voltage selecting signal is the first predetermined logic and the polarity signal is the second predetermined logic, the second selecting circuit provides the first gray level voltage to the first main region via the first data line, provides the third gray level voltage to the first sub region via the second data line, provides the second gray level voltage to the second sub region via the third data line, and provides the fourth gray level voltage to the second main region via the fourth data line; and when both the gamma voltage selecting signal and the polarity signal are the first predetermined logic, the second selecting circuit provides the fourth gray level voltage to the first main region via the first data line, provides the second gray level voltage to the first sub region via the second data line, provides the third gray level voltage to the second sub region via the third data line, and provides the first gray level voltage to the second main region via the fourth data line.

14. The pixel driving circuit of claim 8, wherein the first output end of the first polarity selecting circuit is coupled to the second data line, the second output end of the first polarity selecting circuit is coupled to the first data line, the first output end of the second polarity selecting circuit is coupled to fourth data line, and the second output end of the second polarity selecting circuit is coupled to the third data line.

15. The pixel driving circuit of claim 14, wherein:

when both the gamma voltage selecting signal and the polarity signal are the second predetermined logic, the second selecting circuit provides the fourth gray level voltage to the first main region via the first data line, provides the second gray level voltage to the first sub region via the second data line, provides the third gray level voltage to the second sub region via the third data line, and provides the first gray level voltage to the second main region via the fourth data line; and when the gamma voltage selecting signal is the second predetermined logic and the polarity signal is the first predetermined logic, the second selecting circuit provides the first gray level voltage to the first main region via the first data line, provides the third gray level voltage to the first sub region via the second data line, provides the second gray level voltage to the second sub region via the third data line, and provides the fourth gray level voltage to the second main region via the fourth data line.

16. A pixel driving circuit, comprising:

a first pixel, comprising a first main region and a first sub region, wherein the first main region is coupled to a first data line and a scan line, the first sub region is coupled to a second data line and the scan line, and each of the first main region and the first sub region stores a gray level voltage corresponding to first digital data;

a second pixel, comprising a second main region and a second sub region, wherein the second sub region is coupled to a third data line and the scan line, the second main region is coupled to a fourth data line and the scan line, and each of the second main region and the second sub region stores a gray level voltage corresponding to second digital data; and a data driving circuit, comprising:

a first digital-to-analog converter, for converting the first digital data or the second digital data to a first gray level voltage according to a positive main region gamma voltage;

a second digital-to-analog converter, for converting the first digital data or the second digital data to a second gray level voltage according to a positive sub region gamma voltage;

a third digital-to-analog converter, for converting the first digital data or the second digital data to a third gray level voltage according to a negative sub region gamma voltage;

a fourth digital-to-analog converter, for converting the first digital data or the second digital data to a fourth gray level voltage according to a negative main region gamma voltage;

a first selecting circuit, for selecting the first digital data according to a gamma voltage selecting signal and a polarity signal, for inputting the first digital data into two digital-to-analog converters of the first, the second, the third and the fourth digital-to-analog converters, and inputting the second digital data into the other two digital-to-analog converters of the first, the second, the third and the fourth digital-to-analog converters; and a second selecting circuit, for distributing the first, the second, the third and the fourth gray level voltages to the first main region, the second main region, the first sub region and the second sub region via the first, the second, the third and the fourth data lines, according to the gamma voltage selecting signal and the polarity signal;

wherein when both of the gamma voltage selecting signal and the polarity signal are a first predetermined logic or a second predetermined logic, the first selecting circuit outputs the second digital data to the first and the third digital-to-analog converters, and the first selecting circuit outputs the first digital data to the second and the fourth digital-to-analog converters;

wherein when the gamma voltage selecting signal is the first predetermined logic and the polarity signal is the second predetermined logic, the first selecting circuit outputs the first digital data to the first and the third digital-to-analog converters, and the first selecting circuit outputs the second digital data to the second and the fourth digital-to-analog converters; and wherein when the gamma voltage selecting signal is the second predetermined logic and the polarity signal is the first predetermined logic, the first selecting circuit outputs the first digital data to the first and the third digital-to-analog converters, and the first selecting circuit outputs the second digital data to the second and the fourth digital-to-analog converters.

17. The pixel driving circuit of claim 16, wherein the data driving circuit further comprises:

a first level shifter, coupled between the first selecting circuit and the first digital-to-analog converter;

a second level shifter, coupled between the first selecting circuit and the second digital-to-analog converter;

a third level shifter, coupled between the first selecting circuit and the third digital-to-analog converter; and a fourth level shifter, coupled between the first selecting circuit and the fourth digital-to-analog converter.

18. The pixel driving circuit of claim 16, wherein the data driving circuit further comprises:

a first data latch, coupled between the first selecting circuit and the first level shifter;

a second data latch, coupled between the first selecting circuit and the second level shifter;

a third data latch, coupled between the first selecting circuit and the third level shifter; and a fourth data latch, coupled between the first selecting circuit and the fourth level shifter.

19. The pixel driving circuit of claim 16, wherein the first selecting circuit comprises:

an XOR gate, for generating a control signal according to the gamma voltage selecting signal and the polarity signal;

a first multiplexer, comprising a first input end for receiving the second digital data, a second input end for receiving the first digital data, a control end for receiving the control signal and an output end, wherein the first multiplexer is for coupling the first input end or the second input end of the first multiplexer to the output end of the first multiplexer according to the control signal;

a second multiplexer, comprising a first input end for receiving the first digital data, a second input end for receiving the second digital data, a control end for receiving the control signal and an output end, wherein the second multiplexer is for coupling the first input end or the second input end of the second multiplexer to the output end of the second multiplexer according to the control signal;

a third multiplexer, comprising a first input end for receiving the second digital data, a second input end for receiving the first digital data, a control end for receiving the control signal and an output end, wherein the third multiplexer is for coupling the first input end or the second input end of the third multiplexer to the output end of the third multiplexer according to the control signal; and a fourth multiplexer, comprising a first input end for receiving the first digital data, a second input end for receiving the second digital data, a control end for receiving the control signal and an output end, wherein the fourth multiplexer is for coupling the first input end or the second input end of the fourth multiplexer to the output end of the fourth multiplexer according to the control signal.

20. The pixel driving circuit of claim 19, wherein:

when both of the gamma voltage selecting signal and the polarity signal are the first predetermined logic or the second predetermined logic, the control signal is the first predetermined logic;

when the gamma voltage selecting signal is the first predetermined logic and the polarity signal is the second predetermined logic, the control signal is the second predetermined logic; and when the gamma voltage selecting signal is the second predetermined logic and the polarity signal is the first predetermined logic, the control signal is the second predetermined logic.

* * * * *